US008544957B2

(12) United States Patent
Lin

(10) Patent No.: US 8,544,957 B2
(45) Date of Patent: Oct. 1, 2013

(54) CHAIR

(76) Inventor: Peter Lin, Nan Tou (TW)

( * ) Notice: Subject to any disclaimer, the term of this patent is extended or adjusted under 35 U.S.C. 154(b) by 422 days.

(21) Appl. No.: 12/899,711

(22) Filed: Oct. 7, 2010

(65) Prior Publication Data

US 2012/0025575 A1 Feb. 2, 2012

(30) Foreign Application Priority Data

Jul. 30, 2010 (TW) ..... 99125430 A

(51) Int. Cl.
*A47C 1/026* (2006.01)
*A47C 1/024* (2006.01)

(52) U.S. Cl.
USPC ..... 297/365; 297/354.11; 297/301.7; 297/301.1

(58) Field of Classification Search
USPC ..... 297/301.1, 301.5, 301.7, 354.11, 297/354.12, 365
See application file for complete search history.

(56) References Cited

U.S. PATENT DOCUMENTS

| | | | | |
|---|---|---|---|---|
| 3,434,756 | A * | 3/1969 | Walkinshaw | 297/301.4 |
| 5,294,178 | A * | 3/1994 | Bogle et al. | 297/302.4 |
| 6,193,314 | B1 * | 2/2001 | Chiang | 297/301.7 |
| 6,921,134 | B1 * | 7/2005 | Hong | 297/301.7 |
| 7,731,286 | B2 * | 6/2010 | Wu | 297/284.4 |

FOREIGN PATENT DOCUMENTS

| | | |
|---|---|---|
| TW | M359978 | 7/2009 |
| TW | I314444 | 9/2009 |

* cited by examiner

*Primary Examiner* — David Dunn
*Assistant Examiner* — Tania Abraham
(74) *Attorney, Agent, or Firm* — Alan Kamrath; Kamrath IP Lawfirm, P.A.

(57) ABSTRACT

A chair includes a supporting structure, a seat moveably mounted on the supporting structure and moveable with respect to the supporting structure in a vertical direction, and a backrest including a first frame pivotally connected to the seat and a second frame separate from and pivotally mounted on the first frame to connect to the seat. Further, a first control device is mounted and concealed between the first and second frames in order to prevent the user from inadvertently colliding with it. The first control device is adjusted for various relative pivotal positions of the first and second frames.

19 Claims, 24 Drawing Sheets

CHAIR

BACKGROUND OF THE INVENTION

1. Field of the Invention

The present invention relates to a chair and control devices connected thereto.

2. Description of the Related Art

TW Pat. No. 1314444 disclose discloses a chair and a control device connected thereto that are adapted to be adjusted to fix a backrest of the chair. The backrest is moveable forwardly or backwardly with respect to a seat of the chair, at various positions with respect to the seat. Unfortunately, the control device suffers a problem that the user is likely to inadvertently touch or collide with it.

TW Pat. No. M359978 discloses a supporting base for a chair including control devices connected thereto for allowing the user to operate. Likewise, each control device suffers a problem that the user is likely to inadvertently touch or collide with it.

The present invention is, therefore, intended to obviate or at least alleviate the problems encountered in the prior art.

SUMMARY OF THE INVENTION

According to the present invention, a chair includes a supporting structure, a seat moveably mounted on the supporting structure and moveable with respect to the supporting structure in a vertical direction, and a backrest including a first frame pivotally connected to the seat and a second frame separate from and pivotally mounted on the first frame to connect to the seat. Further, a first control device is mounted and concealed between the first and second frames in order to prevent the user from inadvertently colliding with it. The first control device is adjusted for various relative pivotal positions of the first and second frames.

It is an object of the present invention to provide a backrest including a first frame and a second frame, with the second frame pivotally connected to the first frame.

It is also an object of the present invention to provide a first control device that is adjusted for various relative pivotal positions of the first and second frames of the backrest.

It is a further object of the present invention to prevent the user from inadvertently colliding with the first control device.

DETAILED DESCRIPTION OF THE PREFERRED EMBODIMENTS

Figure 1:
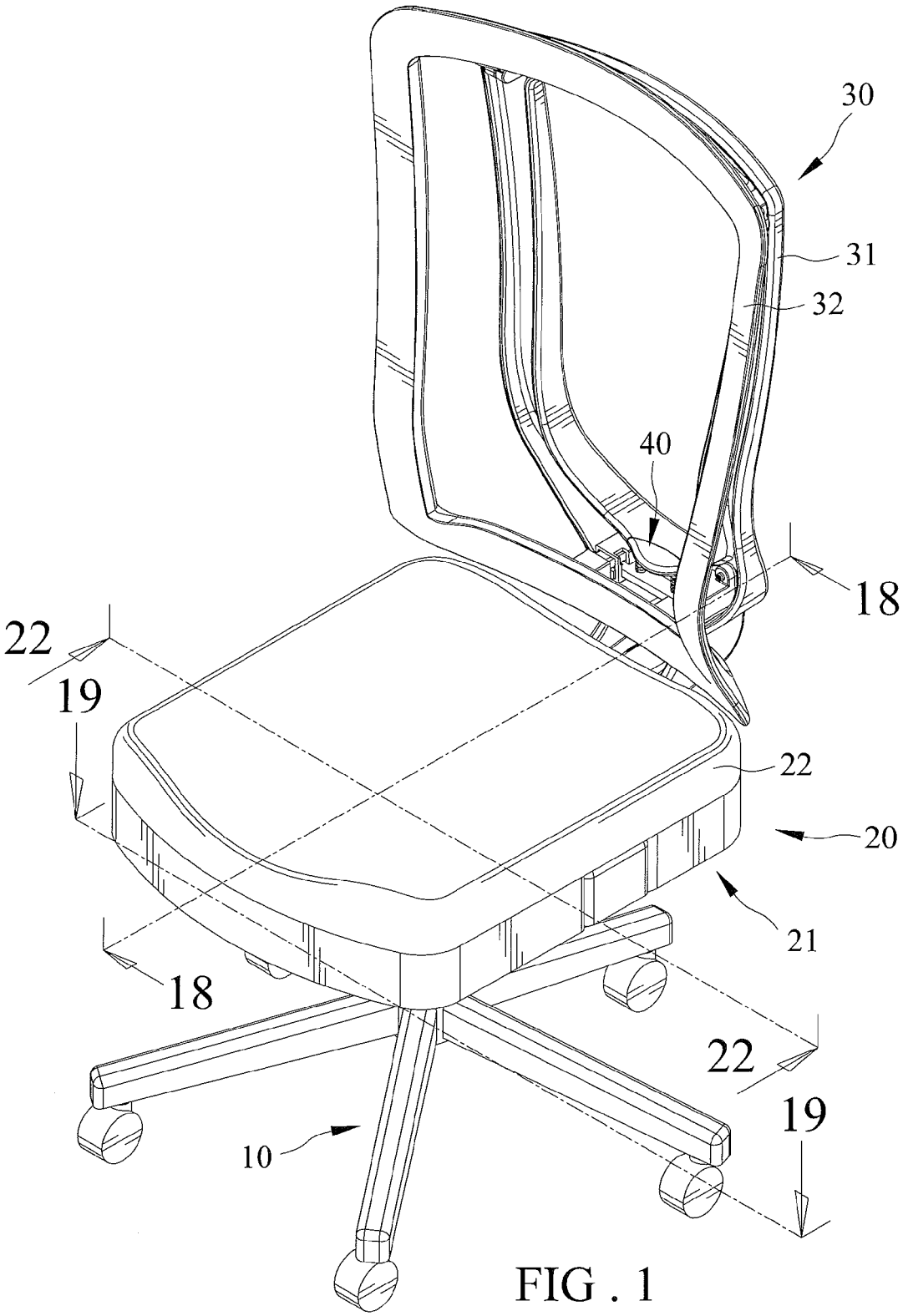
FIG. 1 is a perspective view of a chair in accordance with the present invention.
Figure 2:
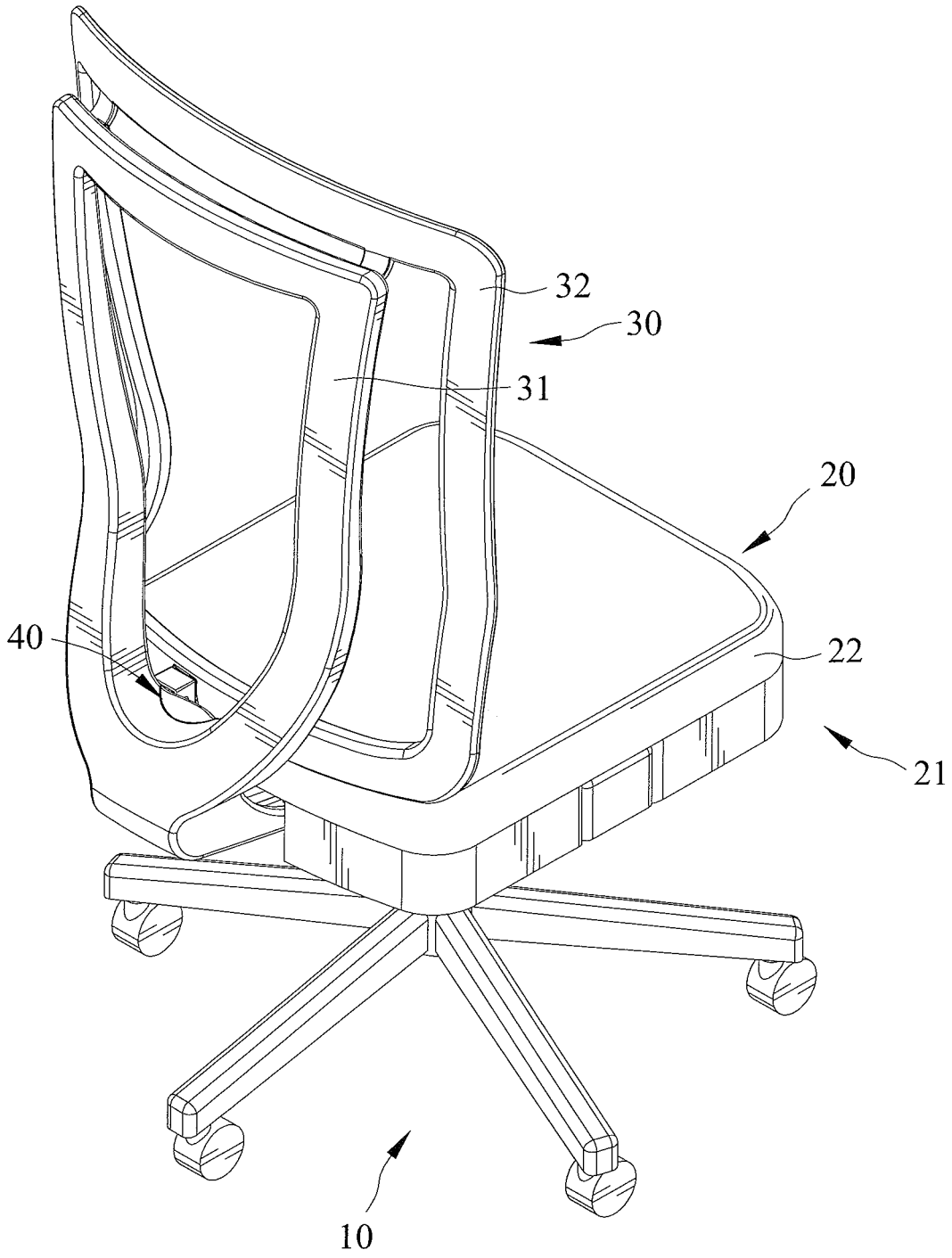
FIG. 2 is another perspective view of the chair shown in FIG. 1.
Figure 3:
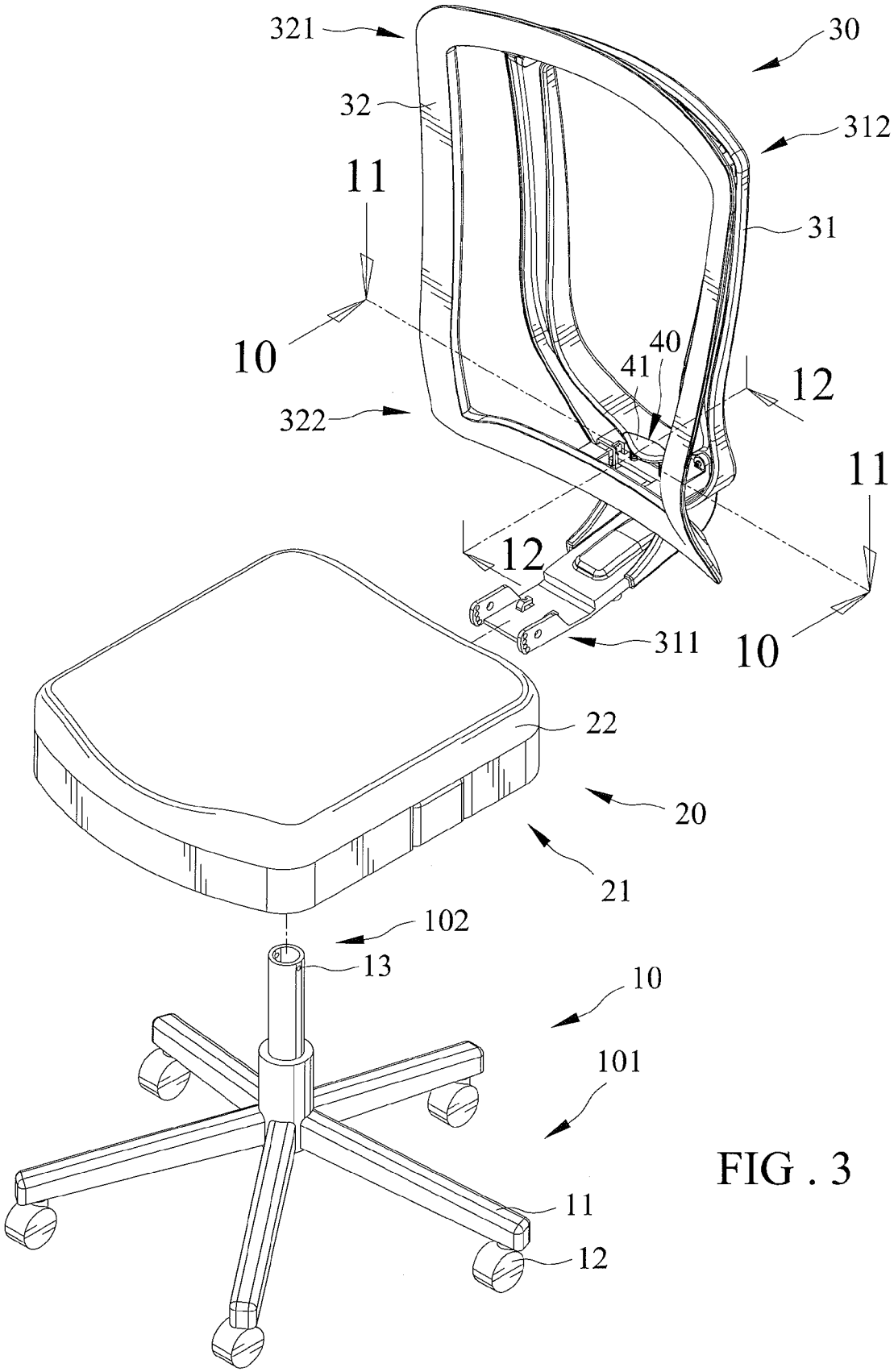
FIG. 3 is an exploded perspective view of the chair shown in FIG. 1.
Figure 4:
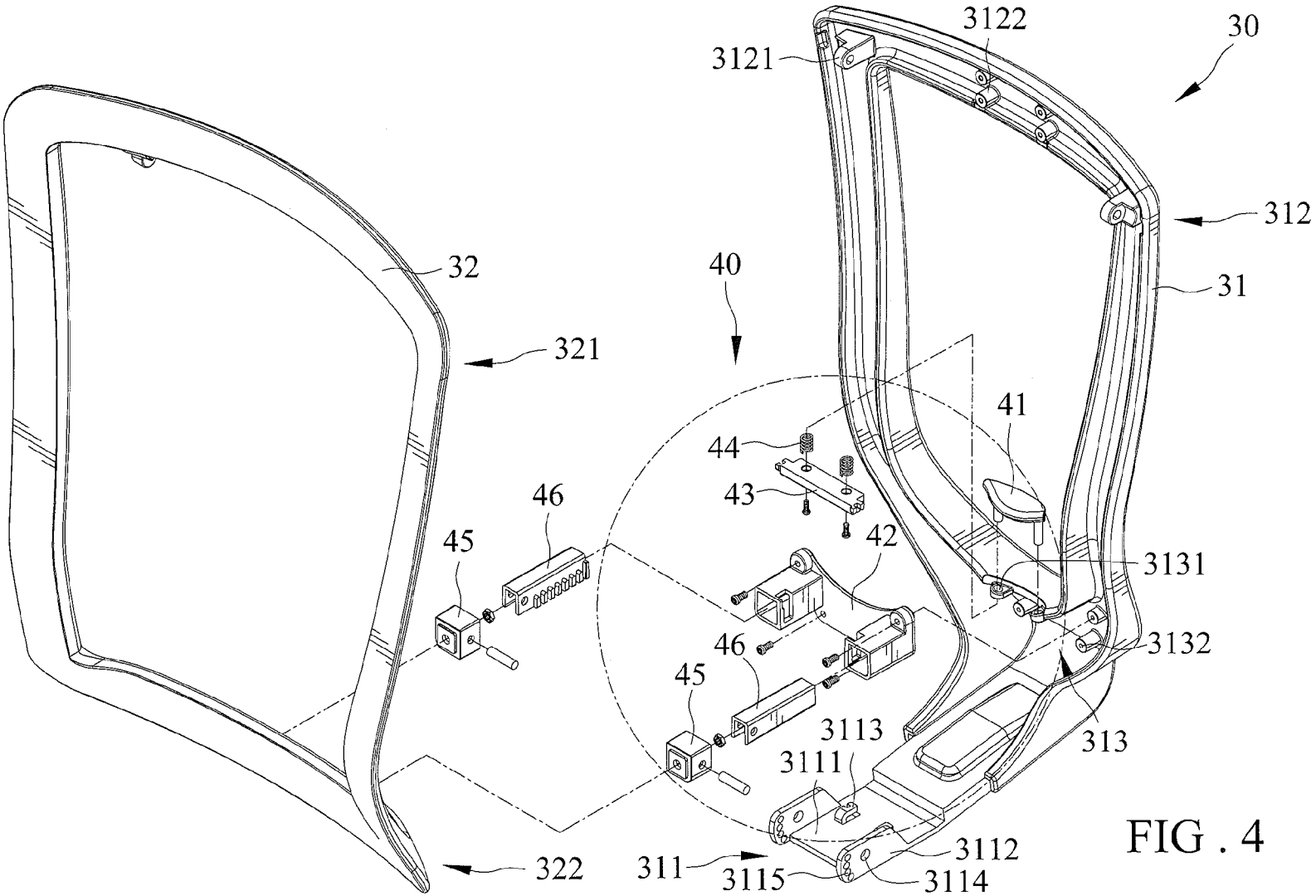
FIG. 4 is another exploded perspective view of the chair shown in FIG. 1 and particularly shows a backrest and a first control device of the chair.
Figure 5:
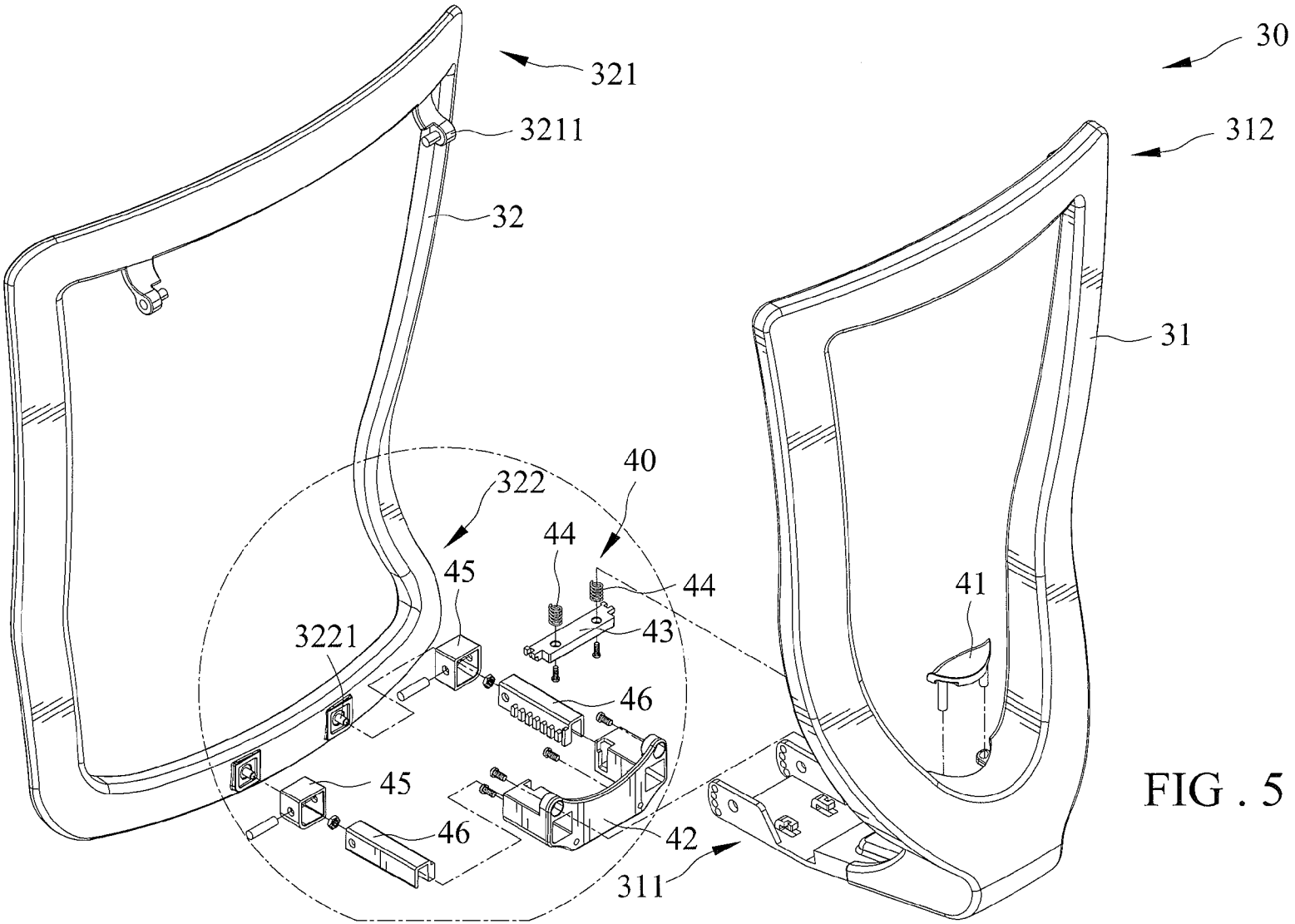
FIG. 5 is another exploded perspective view of the backrest and the first control device shown in FIG. 4.
Figure 6:
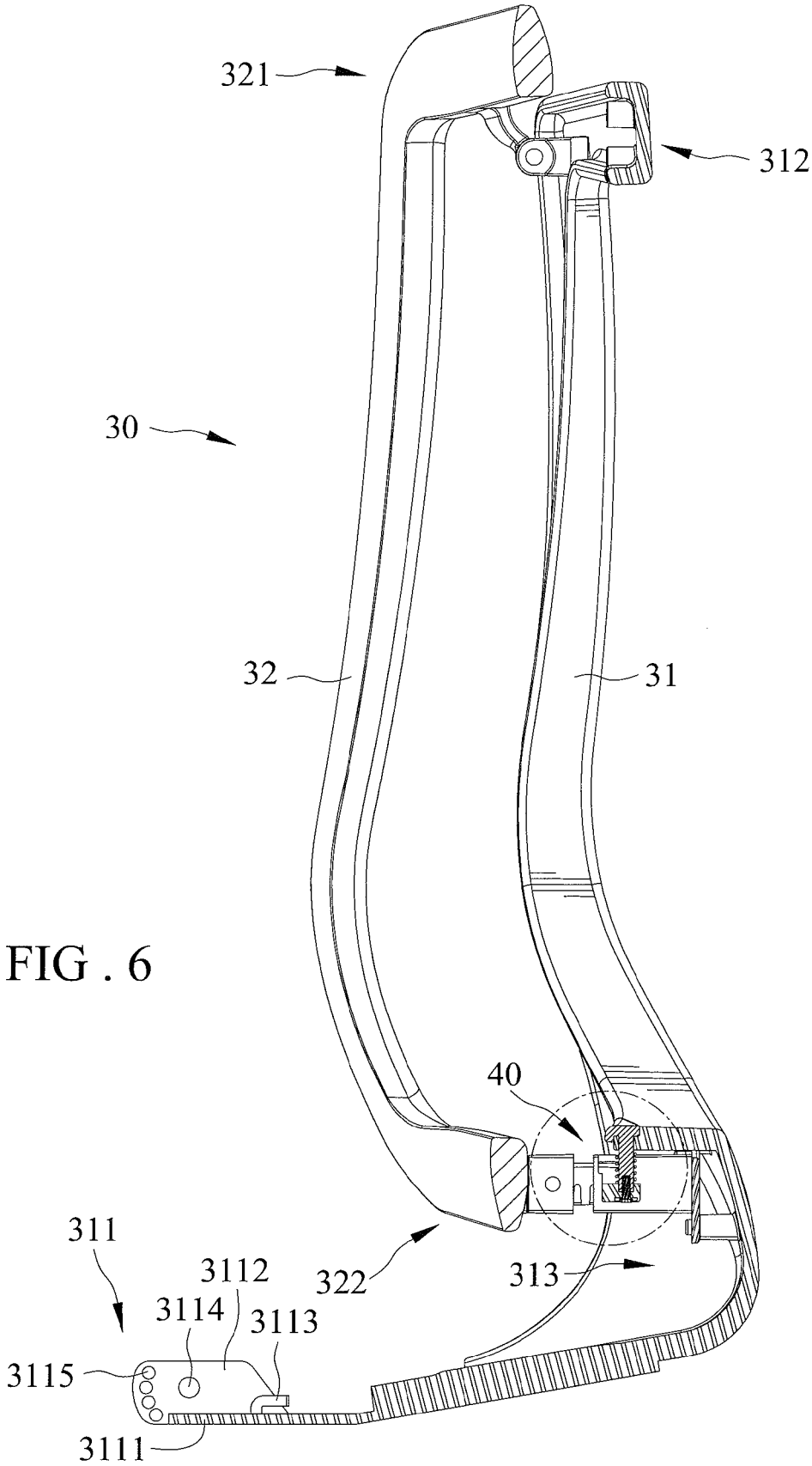
FIG. 6 is a cross-sectional view showing the organization of the backrest and the first control device shown in FIG. 4.
Figure 7:
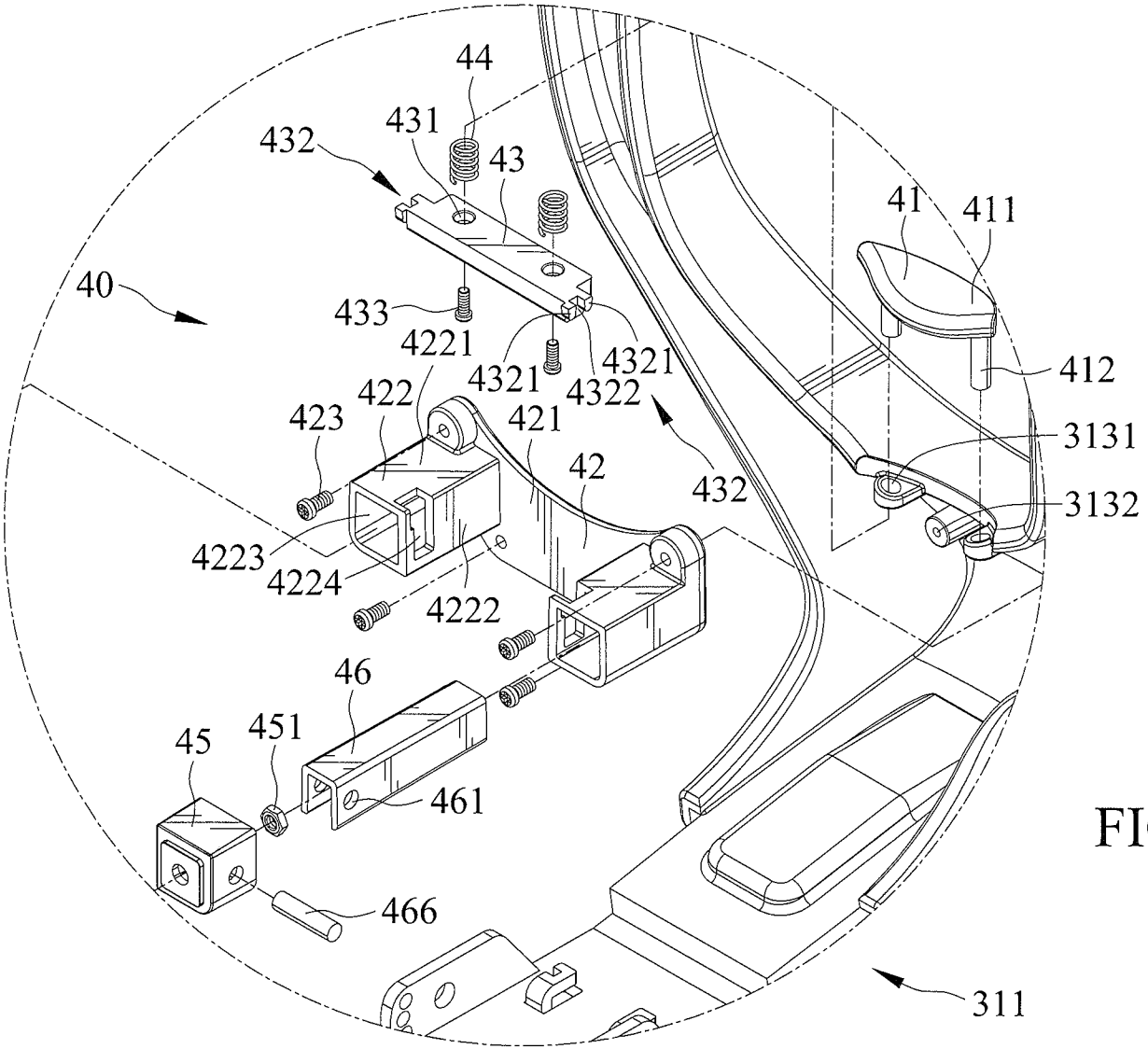
FIG. 7 is a partial, enlarged view of FIG. 4.
Figure 8:
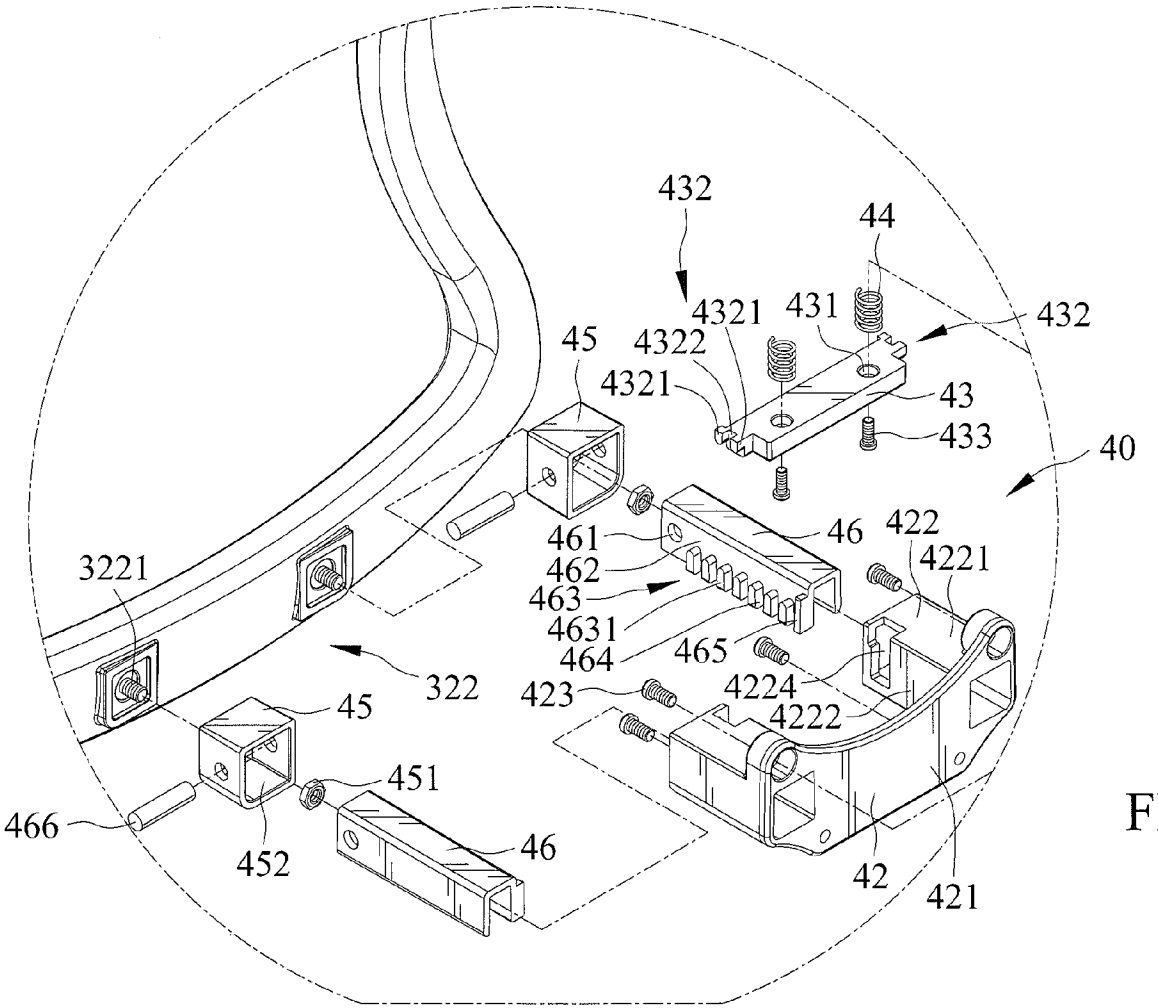
FIG. 8 is a partial, enlarged view of FIG. 5.
Figure 9:
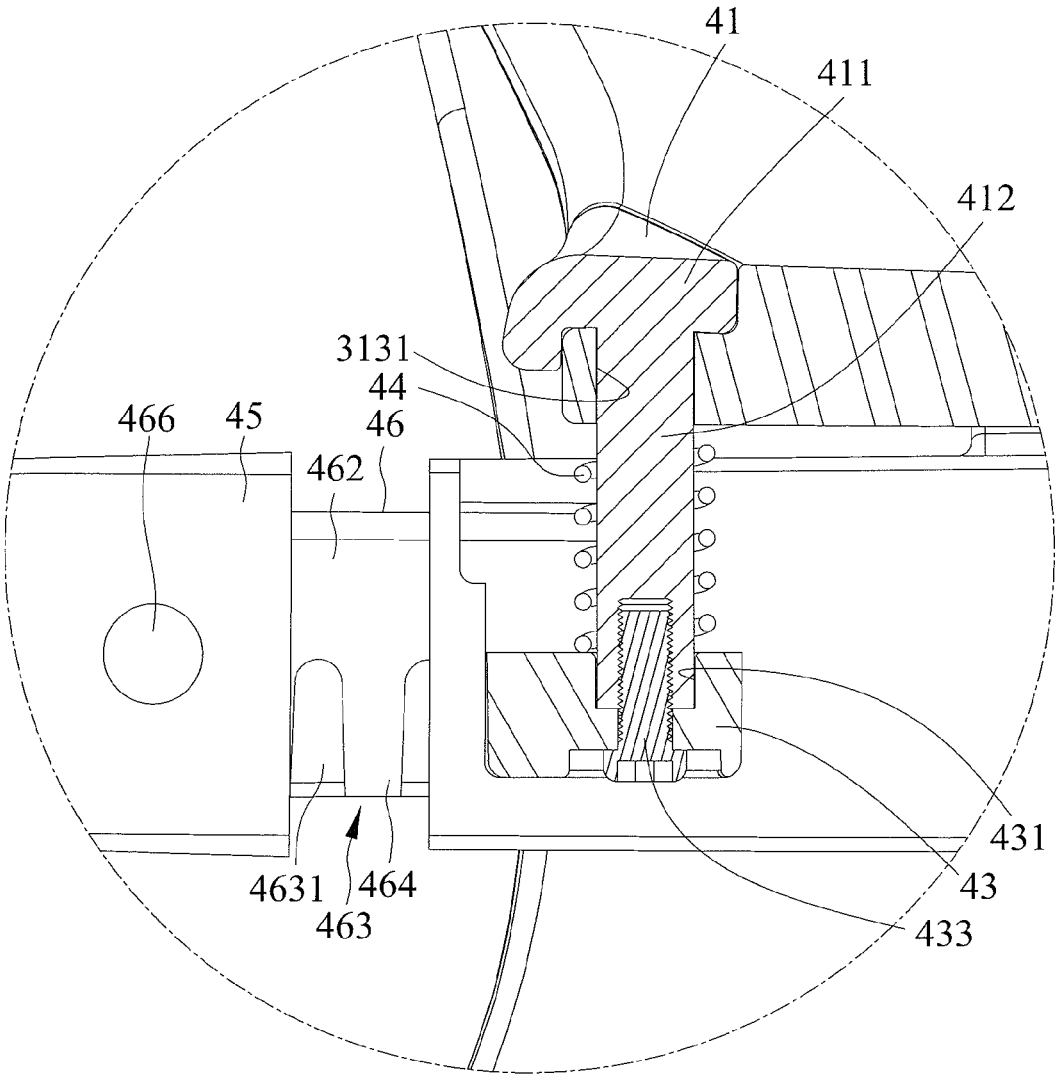
FIG. 9 is a partial, enlarged view of FIG. 6.
Figure 10:
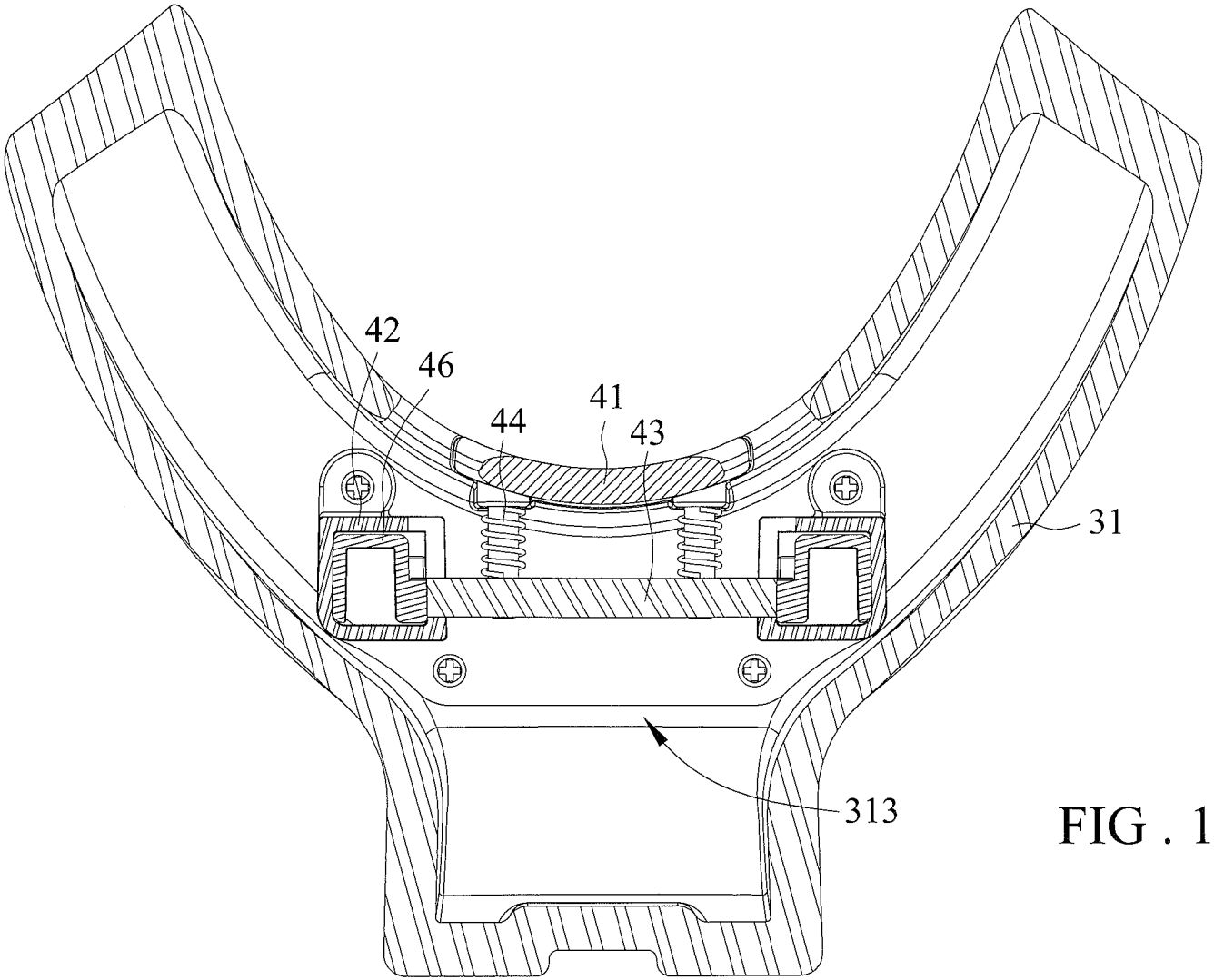
FIG. 10 is a cross-sectional view taken along line 10-10 of FIG. 3.
Figure 11:
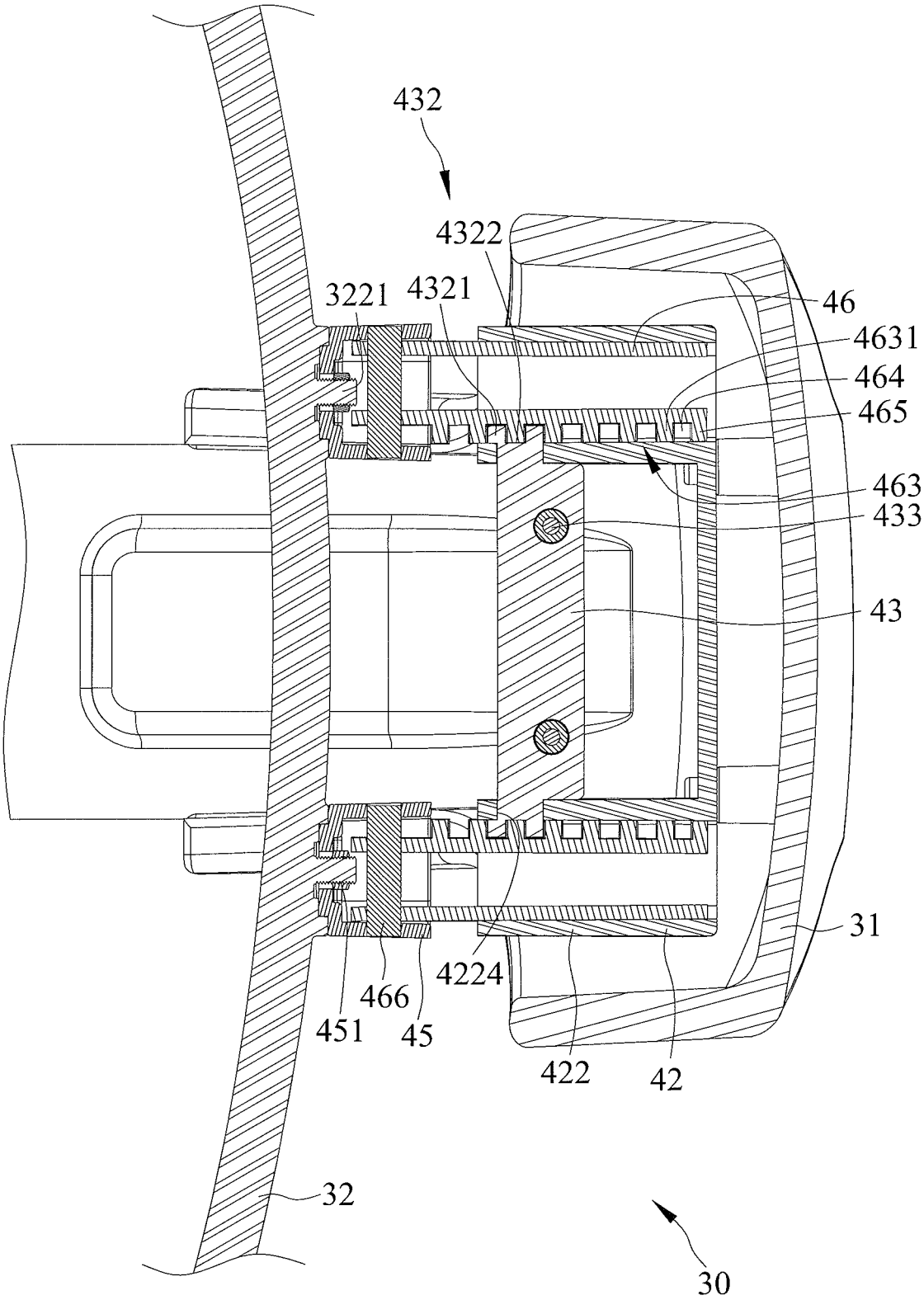
FIG. 11 is a cross-sectional view taken along line 11-11 of FIG. 3.
Figure 12:
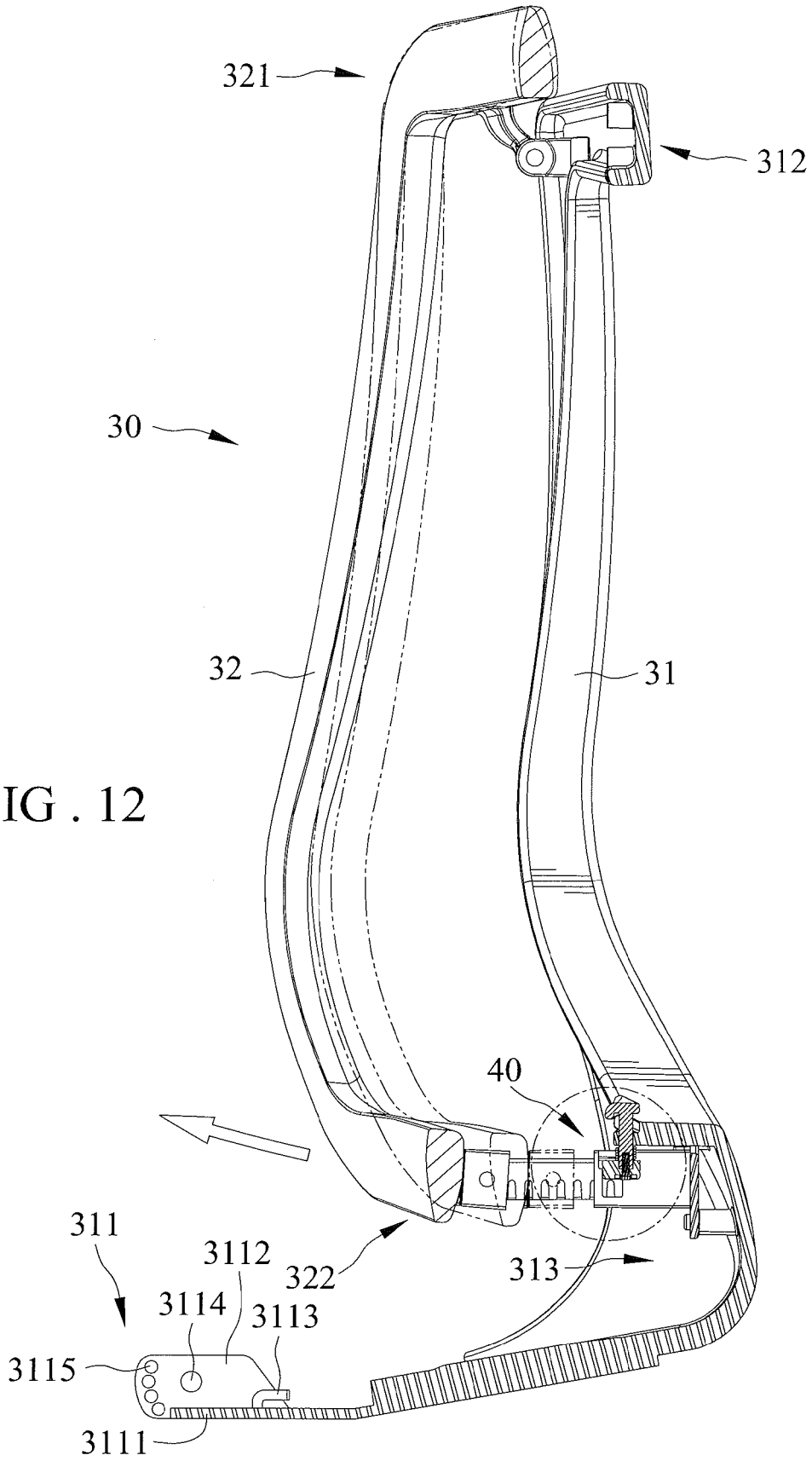
FIG. 12 is a cross-sectional view taken along line 12-12 of FIG. 3 and shows a relative position of the first and second frames of the backrest different than that of FIG. 4.
Figure 13:
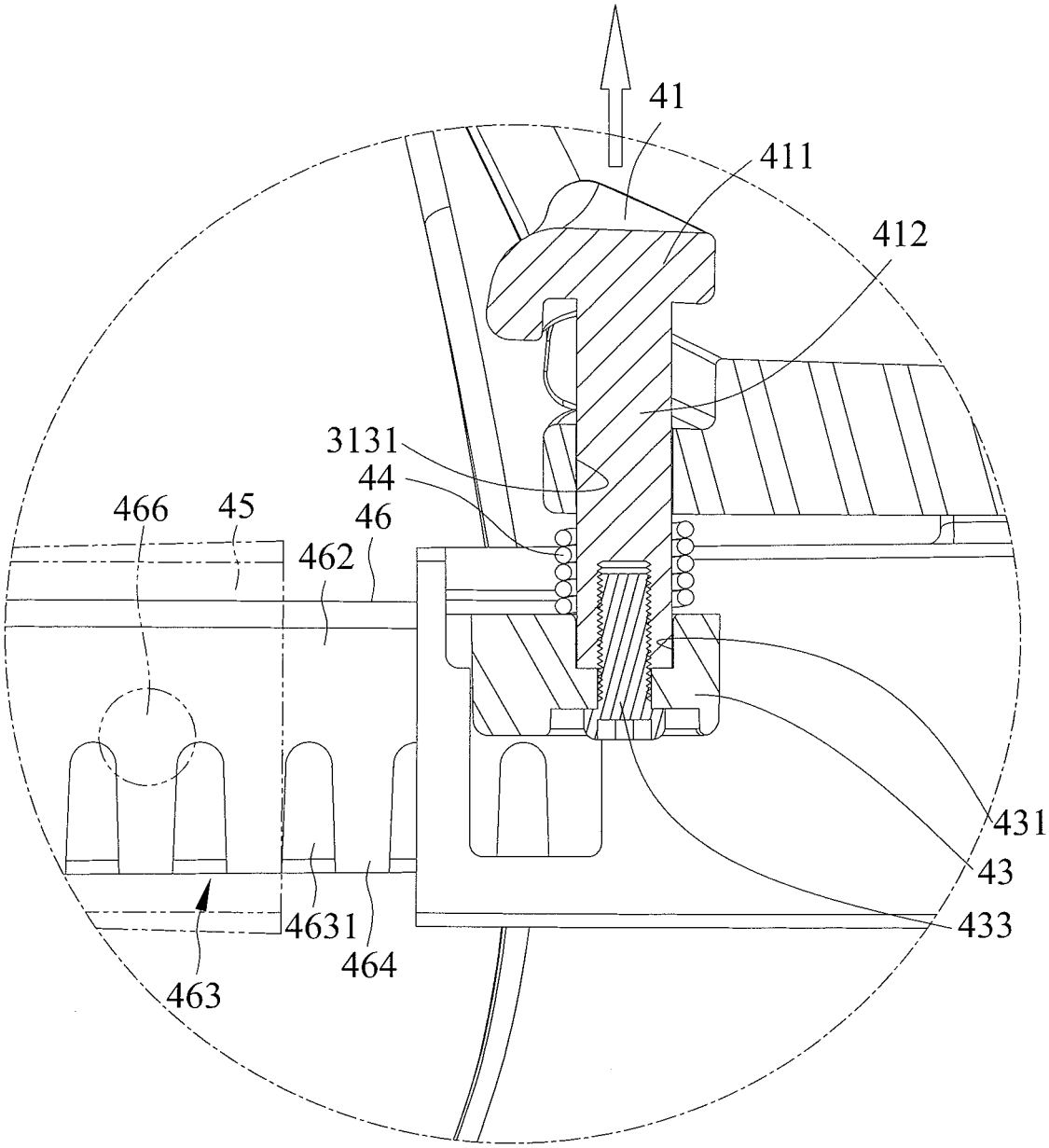
FIG. 13 is a partial, enlarged view of FIG. 12 and shows an arrow indicating an operation direction of the first control device.
Figure 14:
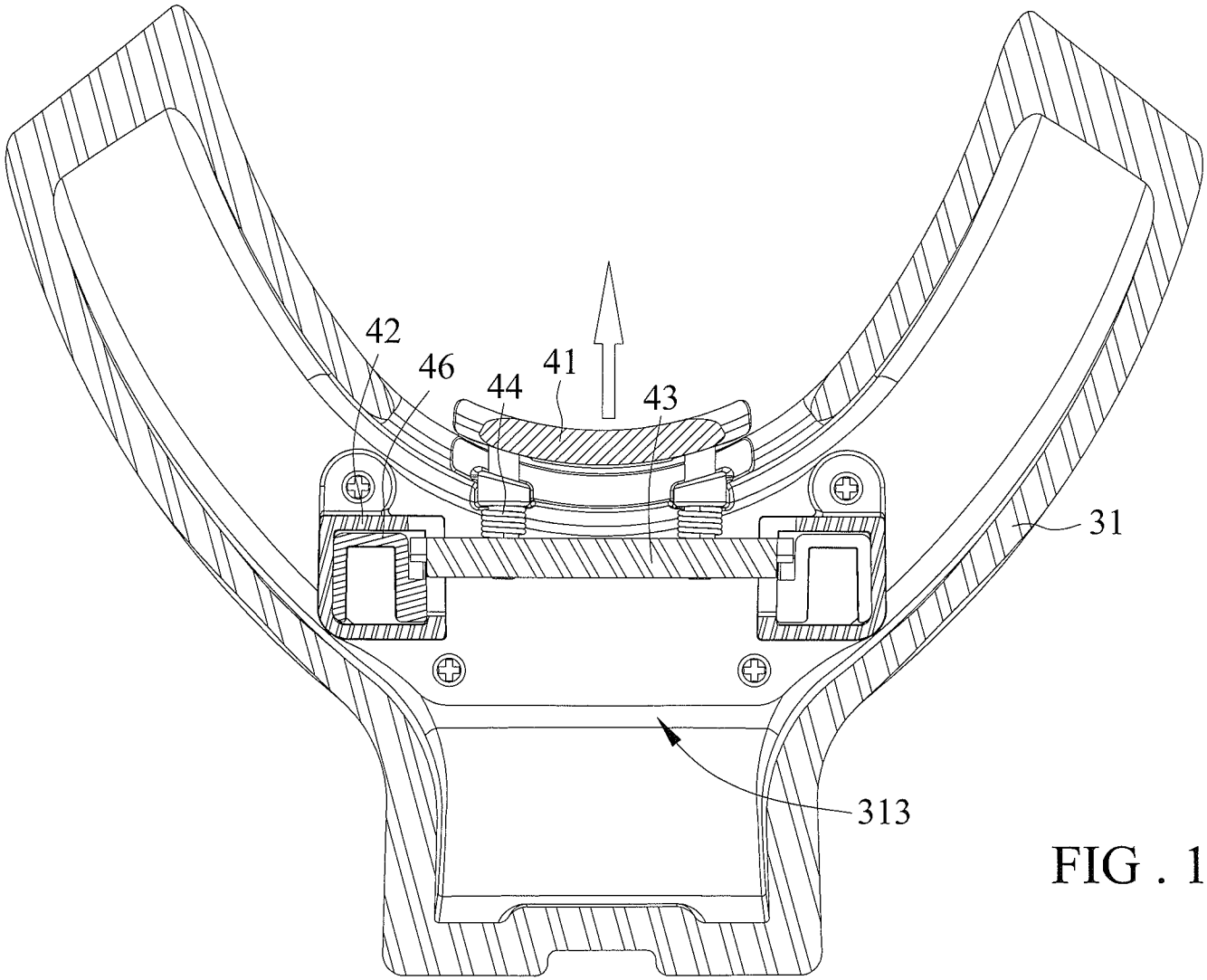
FIG. 14 is an extended cross-sectional view of FIG. 10 and shows an arrow indicating an operation direction of the first control device.
Figure 15:
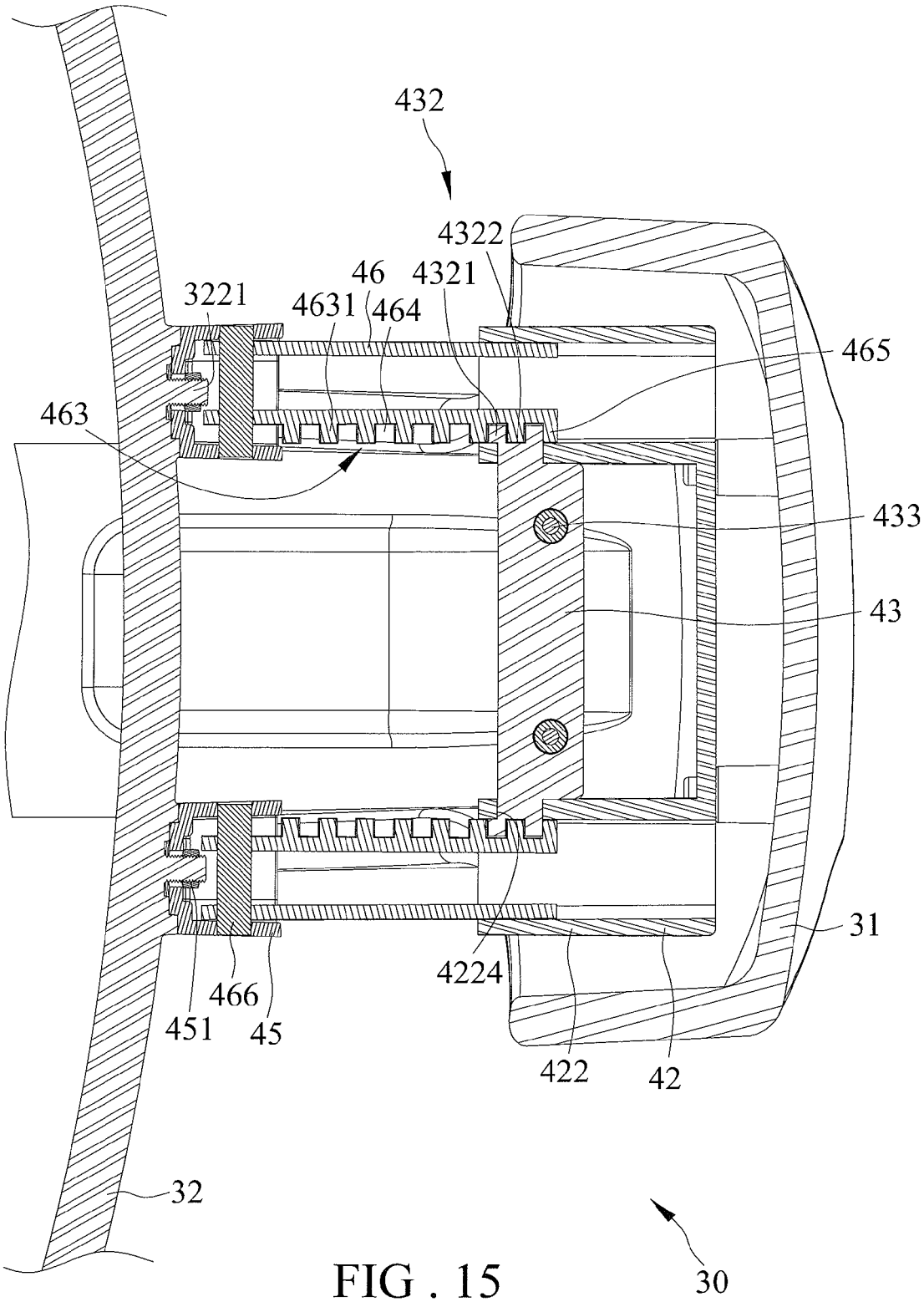
FIG. 15 is another cross-sectional view showing an operation position of the backrest different than that of FIG. 11.
Figure 16:
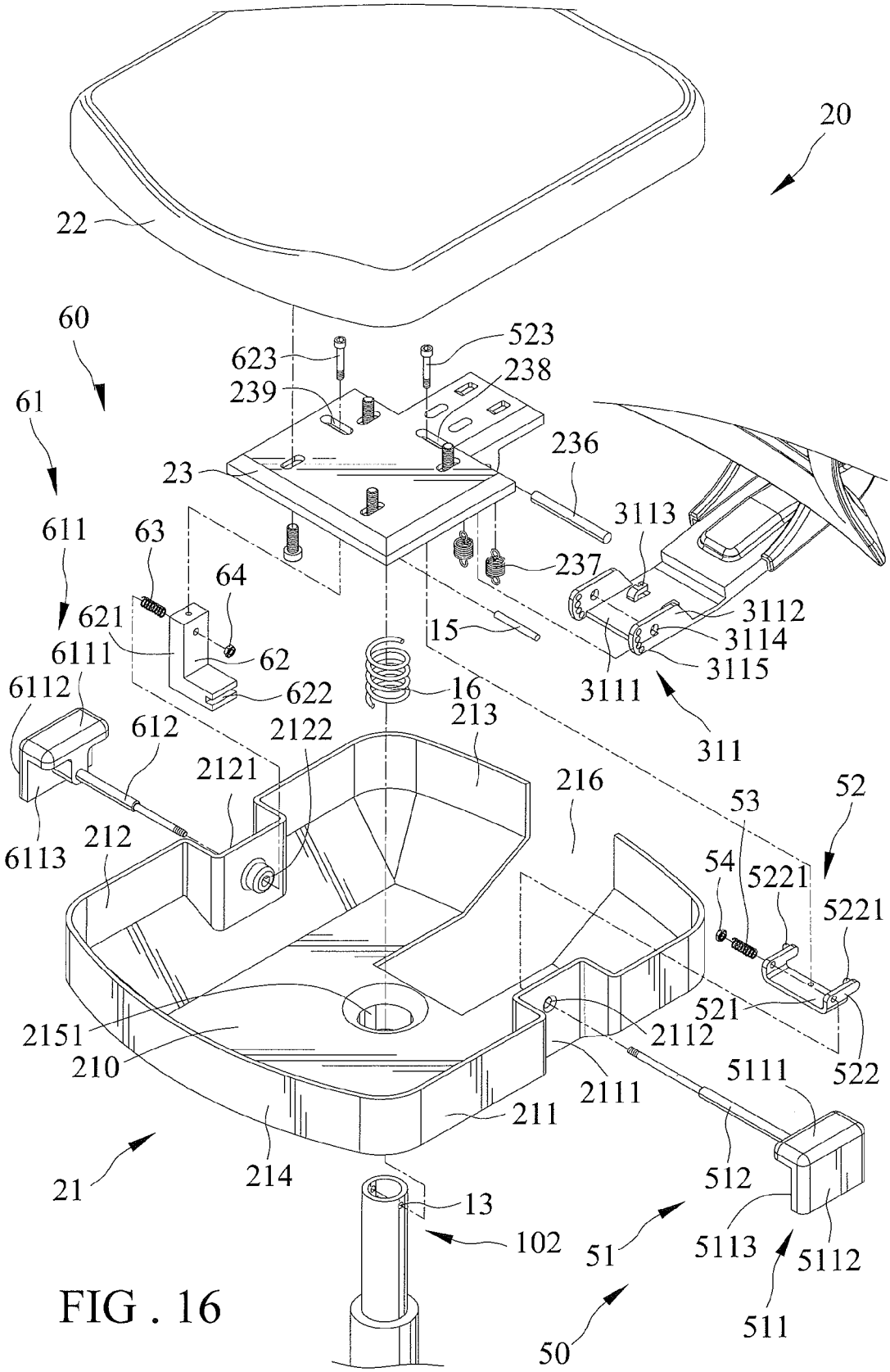
FIG. 16 is another exploded perspective view of the chair shown in FIG. 1 and particularly shows a seat, second and third control devices, and a supporting structure of the chair.
Figure 17:
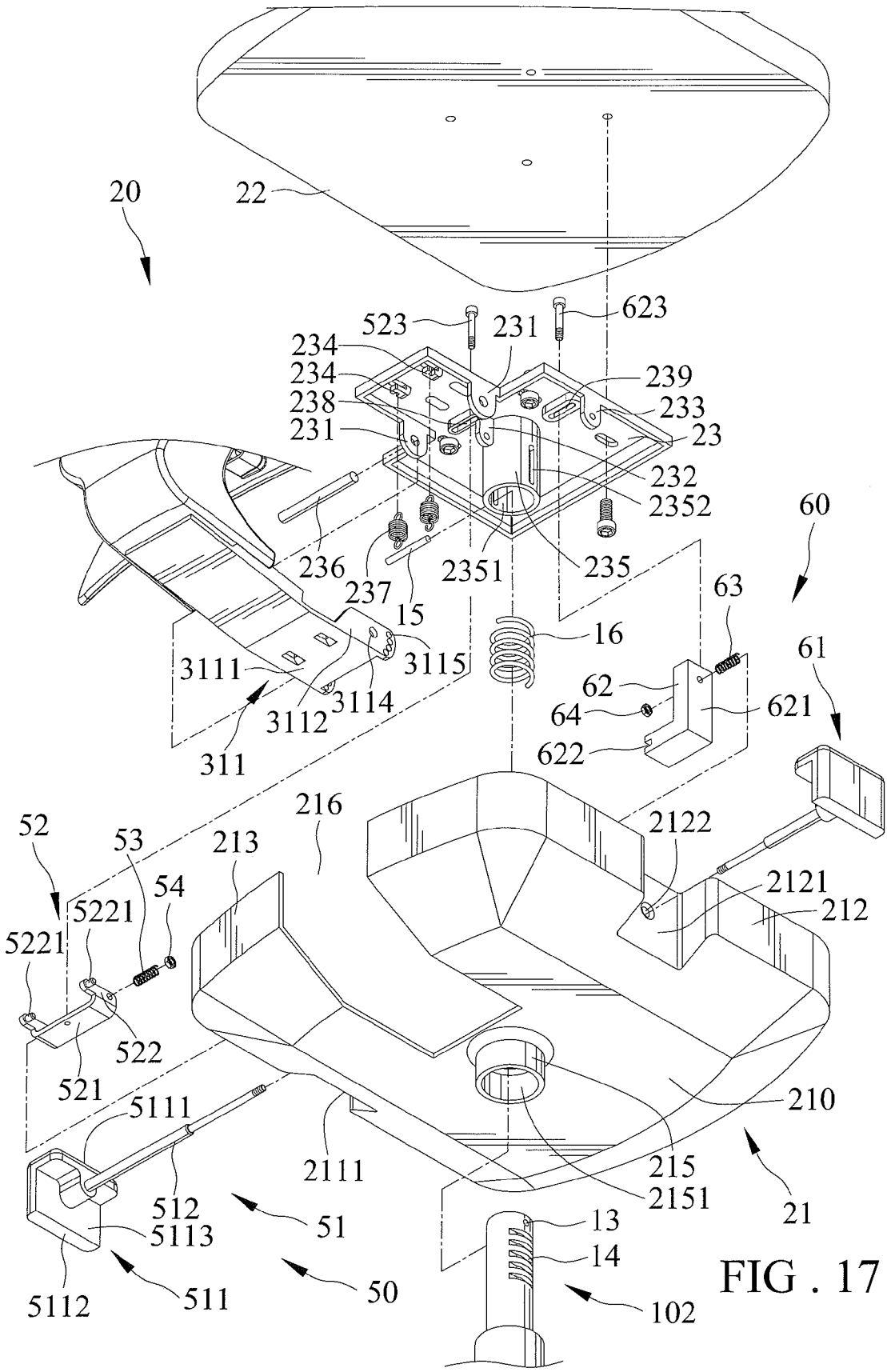
FIG. 17 is another exploded perspective view of the seat, the second and third control devices, and the supporting structure shown in FIG. 16.
Figure 18:
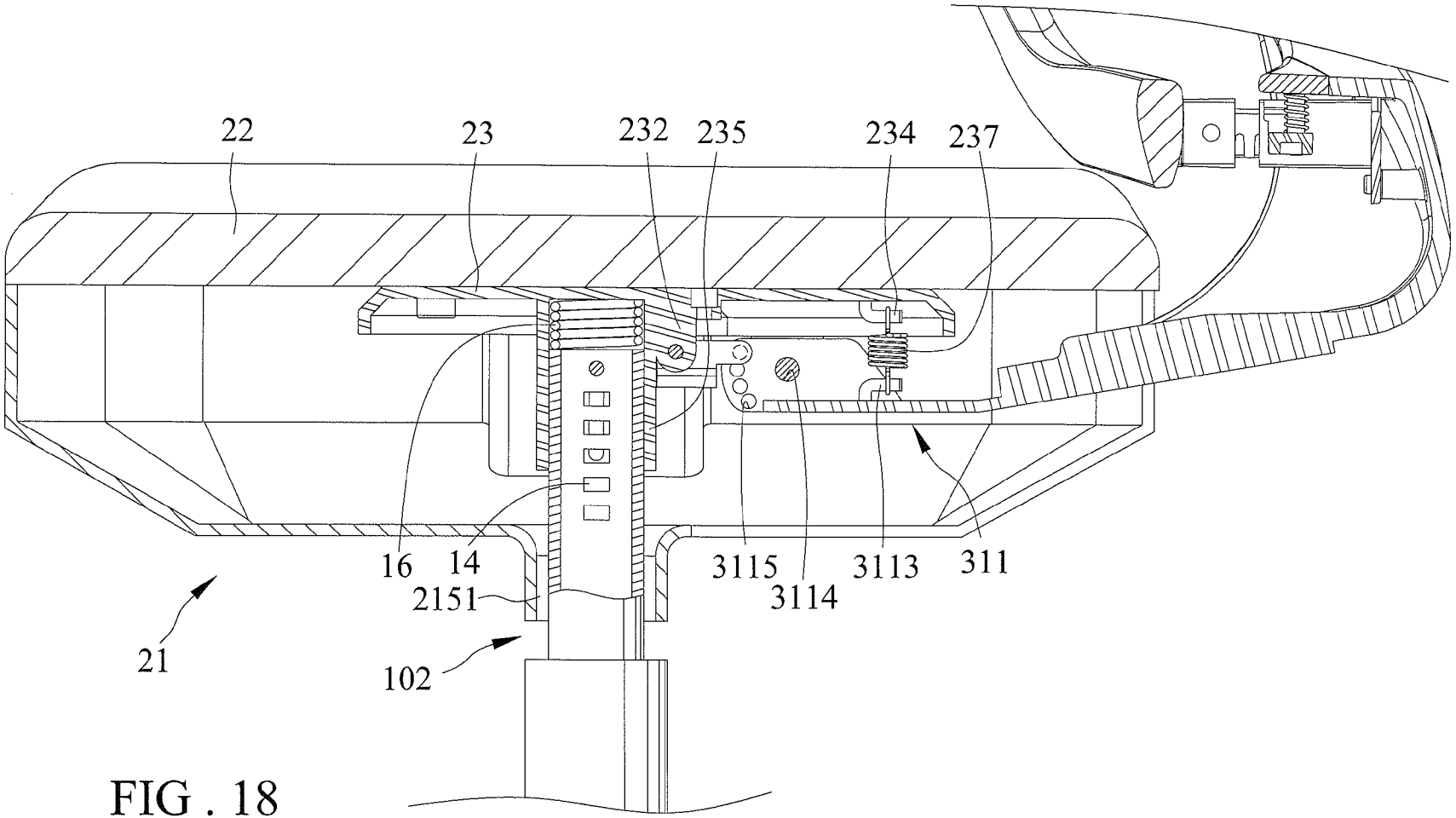
FIG. 18 is a cross-sectional view taken along line 18-18 of FIG. 1.
Figure 19:
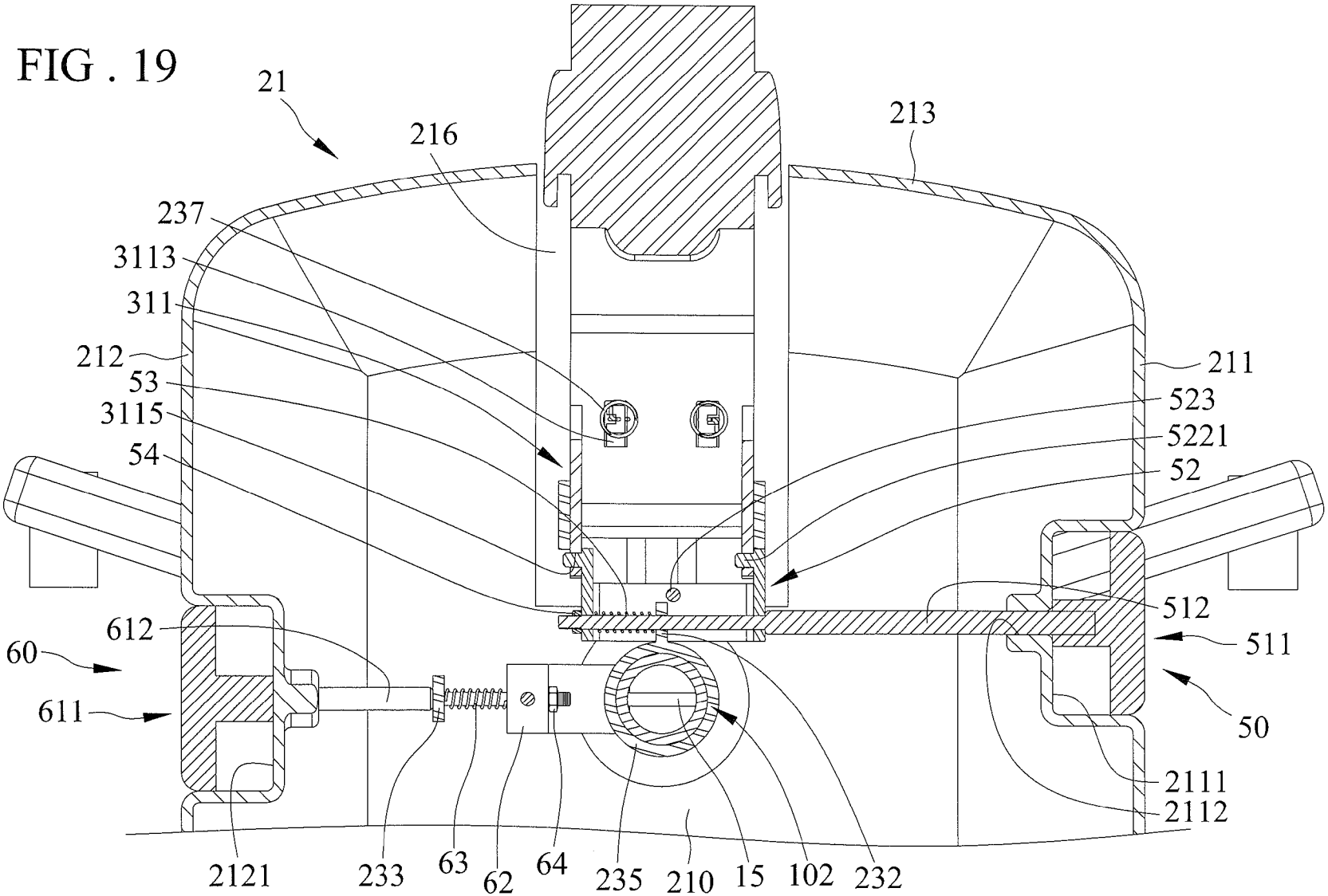
FIG. 19 is a cross-sectional view taken along line 19-19 of FIG. 1.
Figure 20:
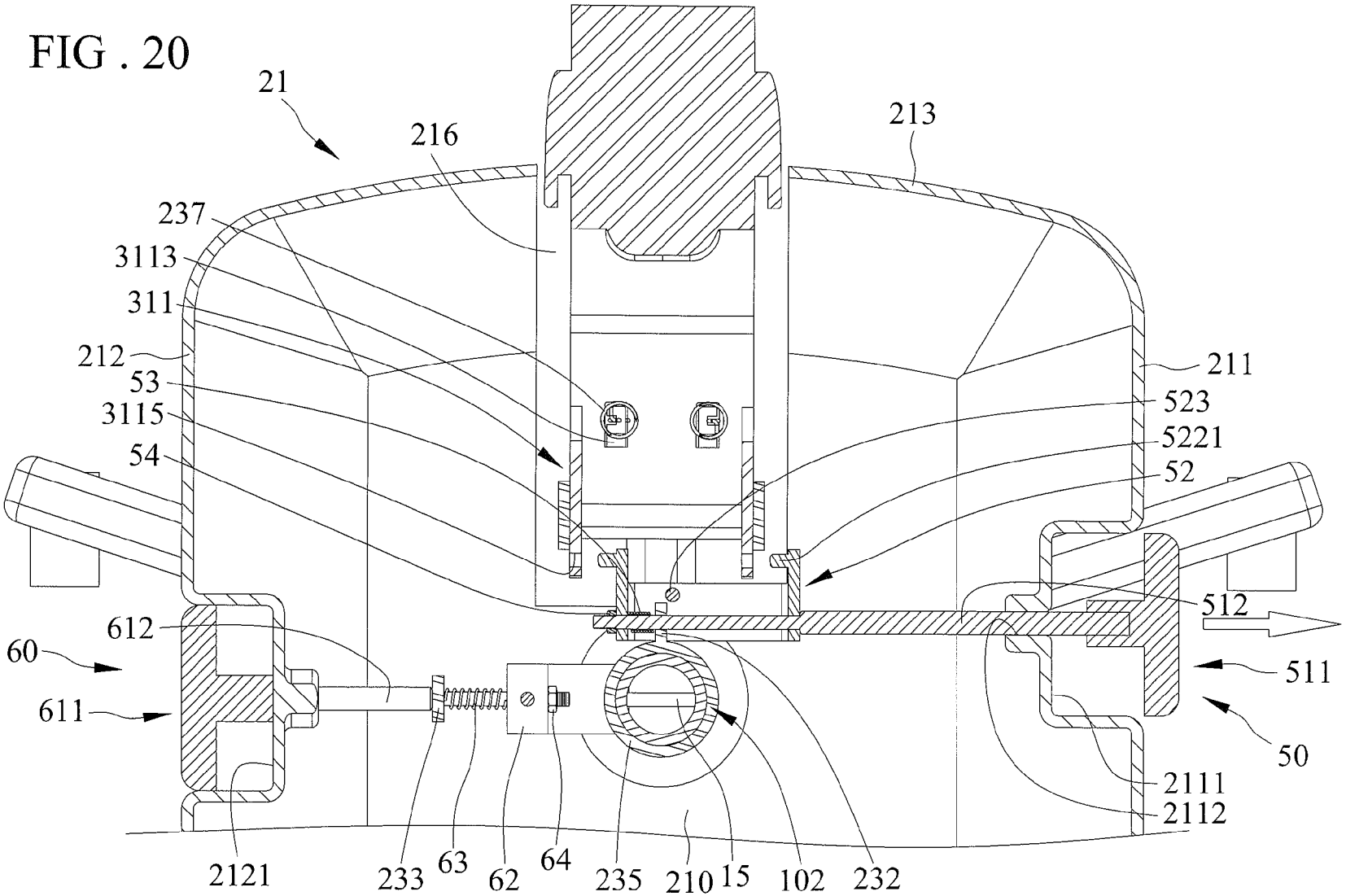
FIG. 20 is an extended cross-sectional view of FIG. 19 and shows an arrow indicating an operation direction of the second control device.

The chair includes a supporting structure 10 supporting a seat 20 and a backrest 30. The seat 20 is moveable with respect to the supporting structure 10 in a vertical direction. The backrest 30 is connected to and tillable with respect to the seat 20. Moreover, the chair includes a first control device 40 to be adjusted for various relative pivotal positions of the first and second frames 31 and 32 of the backrest 30, a second control device 50 to be adjusted for various tilting positions of the backrest 30 with respect to the seat 20, and a third control device 60 to be adjusted for various vertical positions of the seat 20 with respect to the supporting structure 10.

The supporting structure 10 includes a first end 101 and a second end 102 opposite to the first end 101. The first end 101 includes a plurality of extensions 11 extending radially outwardly. Each extension 11 includes a castor 12 mounted thereon. When the chair is supported on a surface, the castors 12 are in contact with the surface and would roll to enable the chair to move easily. The second end 102 includes the seat 20 disposed thereon. The supporting structure 10 further includes an engaging portion 13, a positioning section 14, an engaging member 15 and a resilient member 16. The engaging portion 13 is used to receive the engaging member 15. In the preferred embodiment, the engaging portion 13 is an aperture extending diametrically and transversely through an outer periphery of the supporting structure 10, and the engaging member 15 is an axle to be insertably fitted in the engaging portion 13. The positioning section 14 provides a plurality of vertical positions that the seat 20 can locate with respect to the supporting structure 10. In the preferred embodiment, the positioning section 14 is defined from a plurality of recesses extending into the outer periphery of the supporting structure 10 individually. Also, the recesses are arranged axially. The resilient member 16 is disposed between the second end 102 of the supporting structure 10 and the seat 20 so that the seat 20 is adapted to be biased by the resilient member 16.

The seat 20 includes a seat frame 21, a sitting element 22, and a connecting member 23. The seat frame 21 includes a base 210 and a lateral wall extending upwardly from a circumferential edge of the base 210 and defining a first lateral wall section 211, a second lateral wall section 212 opposite to the first lateral wall section 211, a third lateral wall section 213 extending between the first and second lateral wall sections 211 and 212, a fourth lateral wall section 214 extending between the first and second lateral wall sections 211 and 212 and opposing to the third lateral wall section 213. Additionally, the first lateral wall section 211 includes a first recessed area 2111 formed thereof, and the second lateral wall section 212 includes a second recessed area 2121 formed thereof, respectively. The first recessed area 2111 includes a depth extending in a direction transverse to a direction that directs from the proximal end to the distal end of the first lateral wall section 211. The second recessed area 2121 includes a depth extending in a direction transverse to a direction that directs from the proximal end to the distal end of the second lateral wall section 212. Further, a first receiving passage 2112 is defined on the first recessed area 2111 and includes an orifice extending therethrough and through a bottom side of the first recessed area 2111. Further, a second receiving passage 2122 is defined on the second recessed area 2121 and includes an orifice extending therethrough and through a bottom side of the second recessed area 2121.

The seat frame 21 further includes a collar 215 and a space 216. The collar 215 extends from the base 210 in a direction opposite to that of the lateral wall and includes a hole 2151, which extends therethrough and through the base 210. The space 216 has a length extending from the base 210 towards the third lateral wall section 213, a depth sufficient to extend through respective depths of the base 210 and third lateral wall section 213, and a width transverse to a direction of the length.

The sitting element 22 includes a top surface, a bottom surface opposite to the top surface and a peripheral edge extending laterally along circumferential edges of the top and bottom surfaces.

The connecting member 23 includes a first mounting side and a second mounting side opposite to the first mounting side. The connecting member 23 also includes two first connections 231, a second connection 232, a third connection 233, two hooking members 234, a sleeve 235, a pivot 236, two restoring members 237, a first slot 238, and a second slot 239. Each first, second and third connection 231, 232 and 233 extends outwardly from the second mounting side. Likewise, the hooking members 234 and the sleeve 235 extend outwardly from the second connecting side. Furthermore, the first and second slots 238 and 239 extend through the first mounting side to the second mounting side and, therefore, through the connecting member 23. Additionally, the sleeve 235 includes a compartment 2351 and a slit 2352. The compartment 2351 extends in accordance with a longitudinal direction of the sleeve 235 and has an opening defined at a distal end thereof. The compartment 2351 extends diametrically and transversely through an outer periphery of the sleeve 235. Furthermore, the compartment 2351 extends in a direction at a length in accordance with the longitudinal direction of the sleeve 235. Also, each restoring member 237 is connected to the second mounting side of the connecting member 23 by engaging a hooking end with one hooking member 234.

The sitting element 22 is fixed to and disposed on the seat frame 21 by mounting its bottom surface on the lateral wall of the seat frame 21. The connecting member 23 is connected to the sitting element 22 by fixing its first mounting side to the bottom surface of the sitting element 22. So, to connect the seat 20 to the supporting structure 10, the second end 102 of the supporting structure 10 is inserted through the hole 2151 of the collar 215 of the seat frame 21 and, then, the opening of the compartment 2351 of the connecting member 23 until the second end 102 as well as the engaging portion 13 are received in the compartment 2351. The engaging member 15 is inserted through the slit 2352 disposed on one diametrical end of the sleeve 235, then the engaging portion 13 disposed on one diametrical end of the supporting structure 10, then, the engaging portion 13 disposed on other diametrical end of the supporting structure 10, and the slit 2352 disposed on the other diametrical end of the sleeve 235. Additionally, in order to enable the seat 20 to automatically return from a lower vertical position to a higher vertical position with respect to the supporting structure 10, the resilient member 16 disposed between the second end 102 of the supporting structure 10 and the seat 20 is utilized. Specifically, the resilient member 16 is disposed in the compartment 2351 and has one of two opposing ends abutted against an end wall of the compartment 2351 and the other of the two opposing ends abutted against the second end 102. So when the user sits on the chair, i.e., the user sits on the top surface of the sitting element 22, the seat 20 would move to a lower vertical position with respect to the supporting structure 10 than an original relative vertical position because the second end 102 of the supporting structure 10 is moveable in the compartment 2351 and the engaging member 15 is moveable in the slit 2352. Additionally, the resilient member 16 is gradually compressed and the second end 102 of the supporting structure 10 is gradually moved towards the end wall of the compartment 2351 as the seat 20 is lowered.

Figure 21:
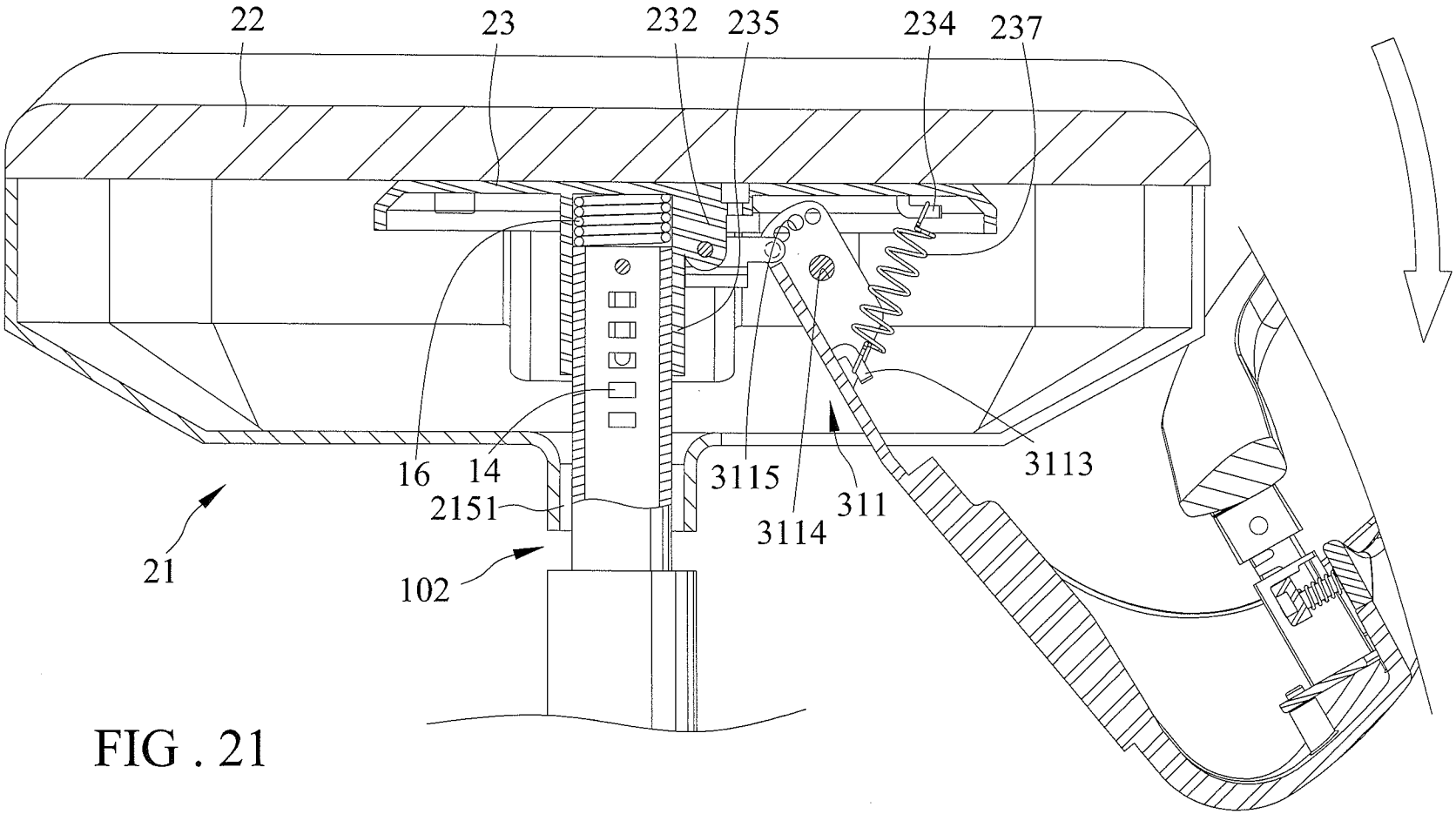
FIG. 21 is a cross-sectional view showing a relative position of the seat and the backrest different than that of FIG. 18 and shows an arrow indicating a moving direction of the backrest.
Figure 22:
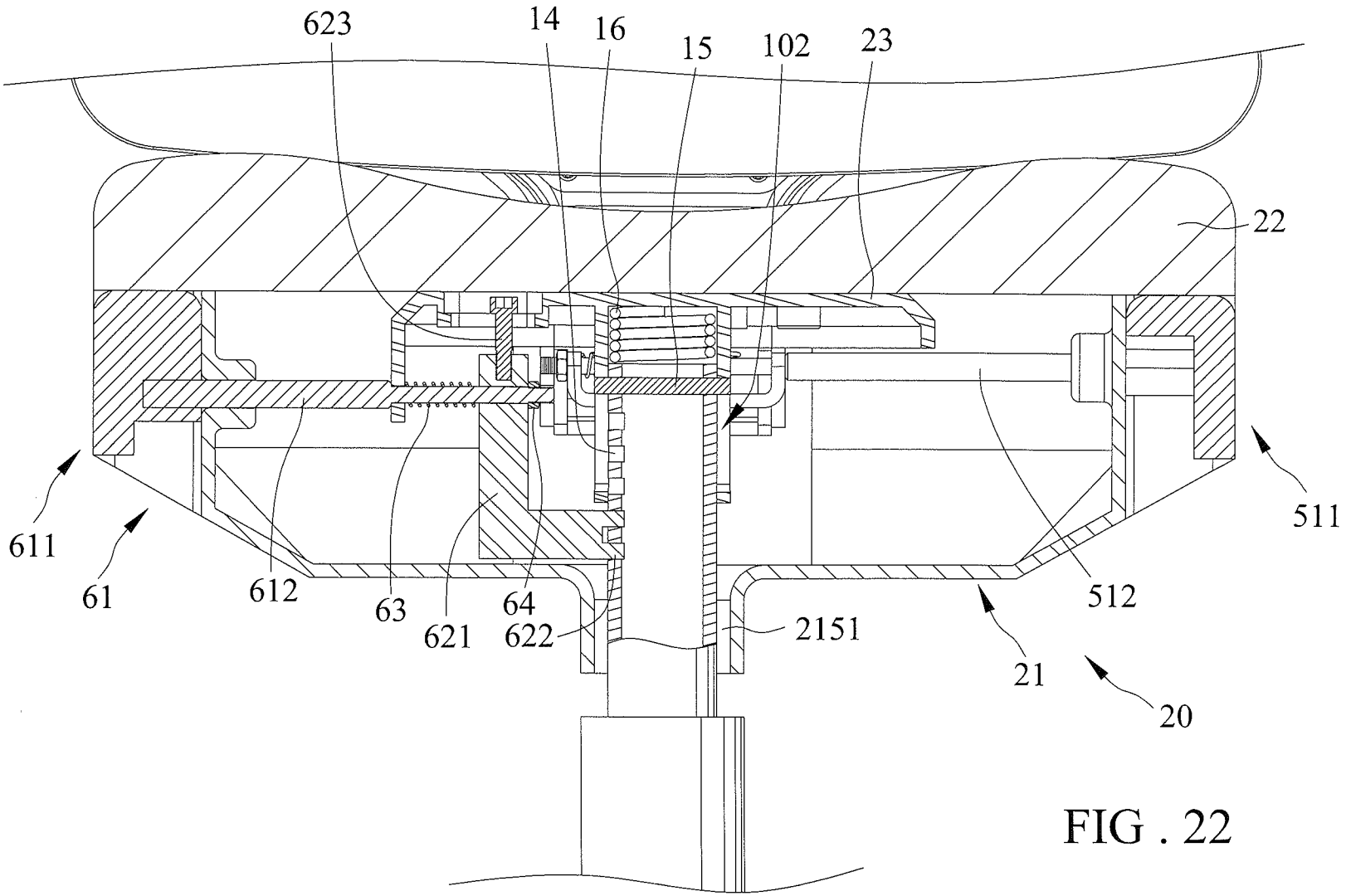
FIG. 22 is a cross-sectional view taken along line 22-22 of FIG. 1.
Figure 23:
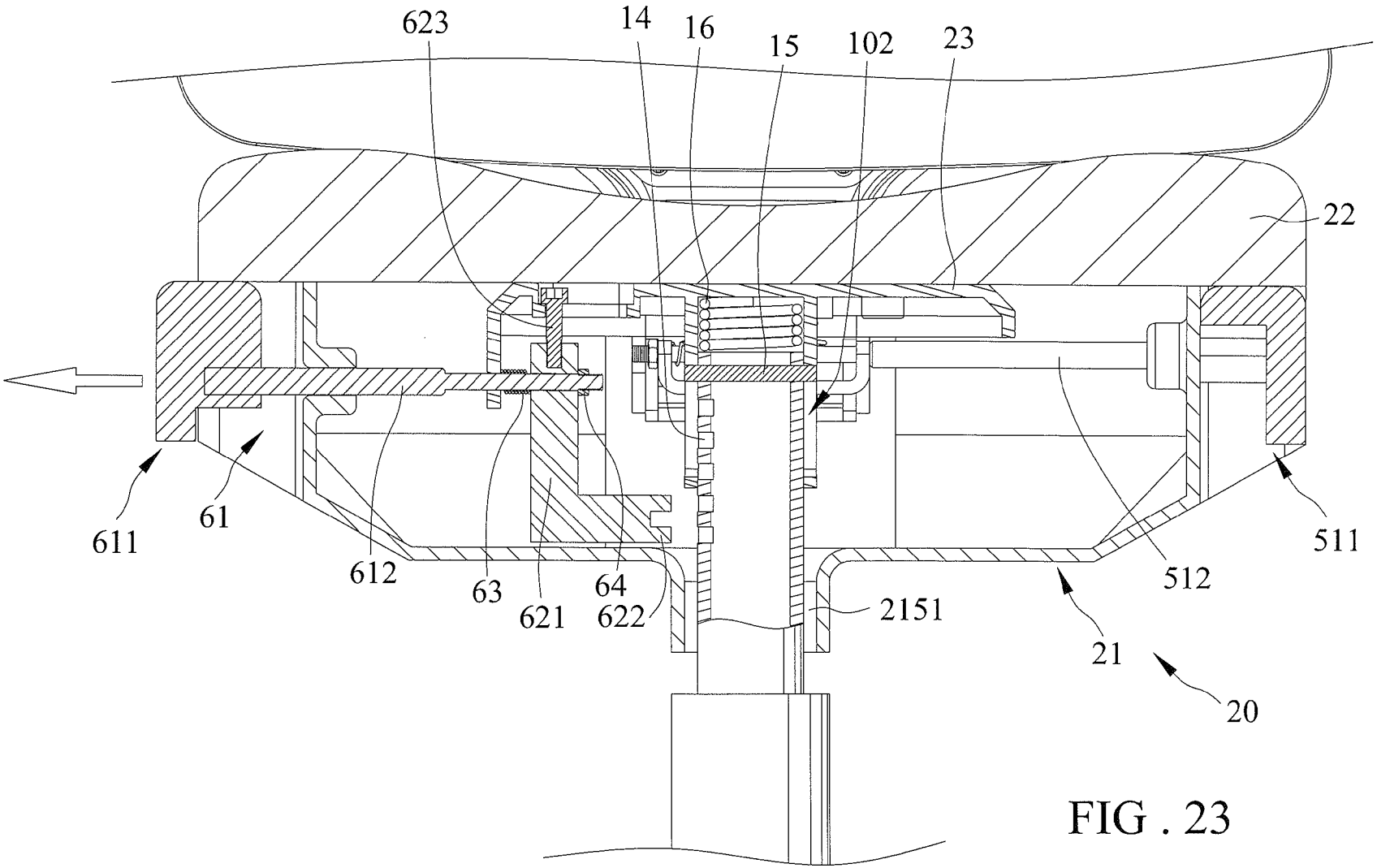
FIG. 23 is an extended cross-sectional view of FIG. 22 and shows an arrow indicating an operation direction of the third control device.
Figure 24:
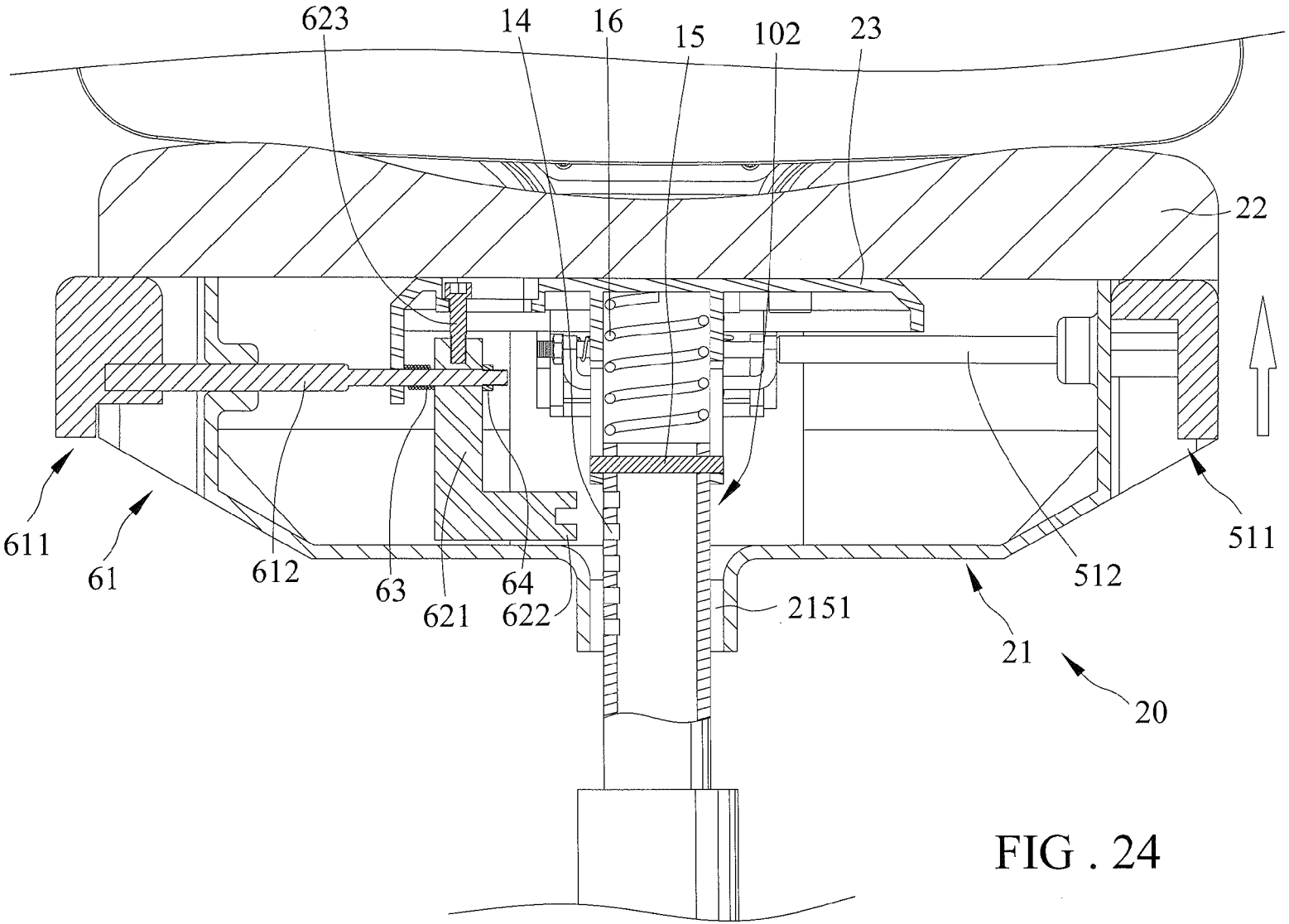
FIG. 24 is an extended cross-sectional view of FIG. 23 and shows a relative position of the seat and the supporting structure different than that of FIG. 23.

The first frame 31 of the backrest 30 includes a fixing end 311 for connecting the backrest 30 to the seat 20. The fixing end 311 includes a base side 3111, two lateral sides 3112, and two hooking members 3113. The two lateral sides 3112 extend from two opposite edges of the base side 3111, respectively. Each lateral side 3112 also includes an orifice 3114 and a positioning section 3115. The orifice 3114 extends through the lateral side 3112. The positioning section 3115 provides a plurality of tilting positions that the backrest 30 can locate with respect to the seat 20. In the preferred embodiment, the positioning section 3115 is defined from a plurality of bores each extending in the lateral side 3112 in a direction in accordance with that of the orifice 3114 individually and radially disposed equally with respect to the orifice 3114. Each hooking member 3113 extends from the base side 3111. To fix the first frame 31 to the seat 20 pivotally, the pivot 236 is inserted through one first connection 231 of the connecting member 23, then, the orifice 3114 of one lateral side 3112 of the fixing end 311 of the first frame 31, then the other first connection 231 of the connecting member 23, and the orifice 3114 of the other lateral side 3112 of the fixing end 311 of the first frame 31. Furthermore, each restoring members 237, which connects to one hooking members 234 on the connecting member 23, has another hooking end anchored to one hooking member 3113 on the fixing end 311 of the first frame 31, resulting in the restoring members 237 being gradually tensioned as the first frame 31 is gradually tilted away from the seat 20, as shown in FIG. 21. On the contrary, the restoring members 237 become gradually released from tension as the first frame 31 is gradually tilted towards the seat 20. In this regard, the first frame 31 is adapted to be tilted towards the seat 20 automatically by restoring a resilient force of each restoring member 237. Additionally, the fixing end 311 is disposed in the space 216 of the seat frame 21 of the seat 20 in order to allow it to expose to the connecting member 23 and enable connection therebetween without being hindered by obstacles. The first frame 31 further includes a first connecting end 312 and a second connecting end 313. The first connecting end 312 includes two pivotal joints 3121 and two joint ends 3122. The second connecting end 313 includes two first joining ends 3131 and a plurality of second joining ends 3132.

The second frame 32 is mounted on the first frame 31 to connect to the seat 20. Also, the second frame 32 is disposed in front of the first frame 31. Thus, when the user sitting on the chair abuts against the backrest 30 he/she will have his/her back in contact with and rested upon the second frame 32. Typically, the second frame 32 would have a cushion (not shown) on which the user's back rests when he/she abuts against the backrest 30. Additionally, in order to enable the user's back to be more followed and comfortably supported by the backrest 30, the second frame 32 is pivotal to a desired position with respect to the first frame 31. So, the second frame 32 includes a first connecting end 321. The first connecting end 321 includes two pivotal joints 3211. The second frame 32 is pivotally connected to the first frame 31 by engaging the two pivotal joints 3211 thereof with the two pivotal joints 3121 of the first frame 31, respectively. The second frame 32 further includes a second connecting end 322. The second connecting end 322 includes two joining ends 3221.

As set forth, the first control device 40 is utilized to adjust the second frame 32 to pivot with respect to the first frame 31, and in order to prevent the user from inadvertently colliding with it, the first control device 40 is mounted and concealed between the first and second frames 31 and 32. The first control device 40 includes a first control member 41, a support bracket 42, a locking member 43, two restoring members 44, two retaining members 45, and two extending members 46. The first control member 41 includes an operation portion 411 for the user to touch to urge the first control member 41. The first control member 41 further includes two legs 412 extending from a bottom side of the operation portion 411 and inserted through the two first joining ends 3131 of the second connecting end 313 of the first frame 31 so that the first control member 41 is hooked to the first frame 31. The supporting bracket 42 is fixed to the second connecting end 313 of the first frame 31 and includes a fixing base 421, two receiving sections 422 extending from the fixing base 421, and a plurality of fasteners 423. In this regard, the supporting bracket 42 is fixed to the first frame 31 by inserting the plurality of fasteners 423 through the fixing base 421 and then engaging with the plurality of second joining ends 3132, respectively. Additionally, each receiving section 422 is hollow and includes a peripheral edge defining a top peripheral edge 4221 and a lateral peripheral edge 4222 forming a cooperated edge, a channel 4223 extending from an end and in accordance with a longitudinal direction thereof, and a slit 4224 extending through the peripheral edge thereof and communicating with the channel 4223. Also, each slit 4224 extends partially on the top peripheral edge 4221 and partially on the lateral peripheral edge 4222 of the related receiving section 422. The two peripheral edges 4221 of the two receiving sections 422 are opposite to each other. The locking member 43 is connected to the first control member 41 and includes two orifices 431 extending therethrough. In this regard, the two legs 412 of the first control member 41 extended through the first joining ends 3131 are inserted through the locking member 43 via the two respective orifices 431 and engaged with two respective fasteners 433 that prevent disengagement of the locking member 43 from the first control member 41. The locking member 43 further includes two locking ends 432 inserted into the two slits 4224 of the two receiving sections 422, respectively. Each locking end 432 includes two protrusions 4321 and a space 4322 disposed between the two protrusions 4321. In the embodiment, each protrusion has a tapered or arcuate apex. The two restoring members 44 are utilized between the first control member 41 and the locking member 43. In this regard, the two legs 412 of the first control member 41 extended through the first joining ends 3131 are inserted through the two restoring members 44, respectively, prior to insertion through the locking member 43. Accordingly, each restoring member 44 has one of two ends abutted against one first joining end 3131 and the other end abutted against the locking member 43. When the first control member 41 is moved upwardly to cause the locking member 43 to go upwardly together, the two restoring members 44 are depressed. On the contrary, the two restoring members 44 become gradually released from tension when the locking member 43 moves downward. In this regard, the locking member 43 is adapted to be moved automatically by a restoring resilient force of the two restoring members 44. The two retaining members 45 are mounted to the second connecting end 322 of the second frame 32. In this regard, the two retaining members 45 are insertably mounted to the two joining ends 3221, respectively, and in the preferred embodiment, the two securing members 451 are used to engage with the two respective joining ends 3221 to prevent the retaining members 45 from disengaging from the second frame 32. Moreover, each retaining member 45 includes a cavity 452 extending from an end thereof. Each of the two extending members 46 includes one of two distal ends moveably received in the channel 4223 of one receiving section 422 of the supporting bracket 42 and the other distal end received in the cavity 452 of one retaining member 45. Each of the two extending members 46 further includes an aperture 461 extending therethrough and transverse to a longitudinal direction thereof, a longitudinal side 462 in accordance with the longitudinal direction thereof, a positioning section 463, and an axle 466. In this regard, when the extending member 46 is connected to the retaining member 45, the distal end of the extending member 46 is received in the cavity 452 of the retaining member 45, and the axle 466 associated with the extending member 46 is inserted through the retaining member 45 and the aperture 461 of the extending member 46 to prevent the extending member 46 from disengagement from the retaining member 45. In the preferred embodiment, each extending member 46 has a cross section of a U shape, which could save the use of material without substantive loss of structural strength. Additionally, the positioning section 463 of each extending member 46 is disposed on the longitudinal side 462 and defined from a plurality of protuberances 4631 which extends outwardly from the longitudinal side 462, and two adjacent protuberances 4631 are spaced by an interval 464. In the preferred embodiment, each protuberance 4631 has a tapered or arcuate apex. Furthermore, the positioning section 463 of each extending member 46 is engagable with one locking end 432 of the locking member 43 and provides a plurality of positions that the locking end 432 engages to enable the second frame 32 to stop at a pivotal position relative to the first frame 31. In this regard, when the locking member 43 is operably moved to cause the second frame 32 to be fixed at a pivotal position with respect to the first frame 31, the two protrusions 4321 in one locking end 432 of the locking member 43 are received in two adjacent intervals 464 of one extending member 46 while the space 4322 between the two protrusions 4321 receives one protuberance 4631 between the two adjacent intervals 464. The two protrusions 4321 in the other locking end 432 of the locking member 43 are received in two adjacent intervals 464 of the other extending member 46 while the space 4322 between the two protrusions 4321 receives one protuberance 4631 between the two adjacent intervals 464. Additionally, the tapered or arcuate apexes of each protrusion 4321 and each protuberance 4631 facilitate engagement of the two locking ends 432 of the locking member 43 with the positioning sections 463 of the respective two extending members 46. On the contrary, when the locking member 43 is operably moved to disengage from the position sections 463 of the two extending members 46 to let the second frame 32 pivot with respect to the first frame 31, the two protrusions 4321 in one locking end 432 of the locking member 43 are not received in two adjacent intervals 464 of one extending member 46 while the space 4322 between the two protrusions 4321 does not receive any protuberance 4631. The two protrusions 4321 in the other locking end 432 of the locking member 43 are not received in two adjacent intervals 464 of the other extending member 46 while the space 4322 between the two protrusions 4321 does not receive any protuberance 4631. Moreover, the extending members 46 are prevented from disengagement from the supporting bracket 42 while pivoting the second frame 32 away from the first frame 31. Specifically, each extending member 46 is prevented from being further moved out of the channel 4223 in which it is disposed when a stopping edge 465 that extends from the longitudinal side 462 thereof abuts against the locking member 43.

Further, a headrest (not shown) may be installed to the backrest 30 for supporting the user's head. In the preferred embodiment, the headrest is to be joined by the two joint ends 3122 of the first frame 31 in order to connect to the backrest 30.

The second control device 50 includes a control member 51, a locking member 52, and a restoring member 53. The control member 51 includes an operation portion 511, and a strut 512. In the preferred embodiment, the operation portion 511 is formed of an L shape that includes a first edge 5111 and a second edge 5112 angled to the first edge 5111. The operation portion 511 also includes a gripping section 5113 defined thereon where a user's hand can be put during the operation of the second control device 50. Furthermore, the operation portion 511 is received in the first recessed area 2111 and disposed outside the lateral wall of the seat frame 21 of the seat 20 and is not extended outside an opening of the first recessed area 2111 when the backrest 30 is fixed at a tilting position with respect to the seat 20, thereby preventing the user from inadvertently colliding with the control member 51. Additionally, the second edge 5112 may be parallel to and flush with the first lateral wall section 211 in order to make the appearance more appealing. The locking member 52 includes a fixing side 521, and two locking sides 522. Furthermore, the locking member 52 is moveably fixed to the connecting member 23 by an engaging member 523. The engaging member 523 is inserted through and moveably retained in the first slot 238 in the connecting member 23 and engages with the fixing side 521 of the locking member 52. The two locking sides 522 extend from the fixing side 521, and each includes a detent 5221 defined thereon. Each detent 5221 is engagable with the position section 3115 defined in one lateral side 3112 in the fixing end 311 of the first frame 31 of the backrest 30 for fixing the backrest 30 at a tilting position with respect to the seat 20. In the preferred embodiment, each detent 5221 is engaged in one of the plurality of bores defining the positioning section 3115 for enabling the backrest 30 to fix at a tilting position with respect to the seat 20. Furthermore, the locking member 52 is connected to the strut 512 of the control member 51, namely, the strut 512 is inserted through the two locking sides 522. Additionally, the restoring member 53 has one of two distal ends abutted against the second connection 232 and the other distal end abutted against one locking side 522 and is connected to the strut 512 of the control member 51. In the preferred embodiment, the strut 512 also extends through the second connection 232. Further, a securing member 54 is used to engage with the strut 512 to prevent the locking member 52 from disengagement from the strut 512. In this regard, when operably moving the control member 51 with respect to the seat frame 21 of the seat 20, the locking member 52 is moved together. When releasing the backrest 30 from a fixed tilting position with respect to the seat 20, the two detents 5221 on the respective two locking sides 522 of the locking member 52 are moved to disengage from the two positioning sections 3115, respectively. Additionally, when the detents 5221 are disengaged from the respective positioning sections 3115, the restoring member 53 is depressed. On the contrary, the restoring member 53 becomes gradually released when the detents 5221 move toward the respective positioning sections 3115. In this regard, the locking member 52 is adapted to be moved automatically by a restoring resilient force of the restoring member 53.

The third control device 60 includes a control member 61, a locking member 62, and a restoring member 63. The control member 61 includes an operation portion 611, and a strut 612. In the preferred embodiment, the operation portion 611 is formed of an L shape that includes a first edge 6111 and a second edge 6112 angled to the first edge 6111. The operation portion 611 also includes a gripping section 6113 defined thereon where a user's hand can be put during the operation of the third control device 60. Furthermore, the operation portion 611 is received in the second recessed area 2121 and disposed outside the lateral wall of the seat frame 21 of the seat 20 and is not extended outside an opening of the second recessed area 2121 when the seat 20 is fixed at a vertical position with respect to the supporting structure 10, thereby preventing the user from inadvertently colliding with the control member 61. Additionally, the second edge 6112 may be parallel to and flush with the first lateral wall section 211 in order to make the appearance more appealing. The locking member 62 includes a fixing side 621, and a locking side 622. Furthermore, the locking member 62 is moveably fixed to the connecting member 23 by an engaging member 623. The engaging member 623 is inserted through and moveably retained in the second slot 239 in the connecting member 23 and engages with the fixing side 621 of the locking member 62. The locking side 622 extends from the fixing side 621 and is engagable with the positioning section 14 defined in the supporting structure 10 for fixing the seat 20 at a vertical position with respect to the supporting structure 10. In the preferred embodiment, the fixing side 621 is engaged in one of the plurality of recesses defining the positioning section 14 for enabling the seat 20 to fix at a vertical position with respect to the supporting structure 10. Furthermore, the locking member 62 is connected to the strut 612 of the control member 61. Namely, the strut 612 is inserted through the fixing side 621. Additionally, the restoring member 63 has one of two distal ends abutted against the third connection 233 and the other distal end abutted against the fixing side 621 and is connected to the strut 612 of the control member 61. In the preferred embodiment, the strut 612 also extends through the third connection 233. Further, a securing member 64 is used to engage with the strut 612 to prevent the locking member 62 from disengagement from the strut 612. In this regard, when operably moving the control member 61 with respect to the seat frame 21 of the seat 20, the locking member 62 is moved together. When releasing the seat 20 from a fixed vertical position with respect to the supporting structure 10, the locking side 622 of the locking member 62 is moved to disengage from the positioning section 14. Additionally, when the locking side 622 is disengaged from the positioning section 14, the restoring member 63 is depressed. On the contrary, the restoring member 63 becomes gradually released when the locking side 622 moves toward the positioning sections 14. In this regard, the locking member 62 is adapted to be moved automatically by a restoring resilient force of the restoring member 63.

In view of the forgoing, the first control device 40 is disposed between the first and second frames 31 and 32 of the backrest 30 so the user is prevented from inadvertently colliding with it. The control member 51 of the second control device 50 is exposed outside the lateral wall of the seat frame 21 of the seat 20, but it is not extended outside an opening of the first recessed area 2111 so the user is prevented from inadvertently colliding with the control member 51. Likewise, the control member 61 of the third control device 60 is exposed outside the lateral wall of the seat frame 21 of the seat 20, but it is not extended outside an opening of the second recessed area 2121 so the user is prevented from inadvertently colliding with the control member 61. Furthermore, the second frame 32 of the backrest 30 is pivotal with respect to the first frame 31 thereof so that the backrest 30 has the advantage that enables the user's back to be followed and comfortably supported.

While the specific embodiments have been illustrated and described, numerous modifications come to mind without significantly departing from the spirit of invention, and the scope of invention is only limited by the scope of the accompanying claims.

What is claimed is:

1. A chair comprising:

a supporting structure;

a seat moveably mounted on the supporting structure, wherein the seat is moveable with respect to the supporting structure in a vertical direction, wherein the seat includes a seat frame, a sitting element and a connecting member, with the seat frame including a base and a lateral wall extending upwardly from the base, with the sitting element including a top surface, a bottom surface opposite to the top surface and a peripheral edge extending laterally along circumferential edges of the top and bottom surfaces, with the connecting member mounted to the bottom surface of the sitting element, with the sitting element fixed to and disposed on the seat frame by mounting the bottom surface of the sitting element on the seat frame;

a backrest including a first frame pivotally connected to the seat and a second frame separate from and pivotally mounted on the first frame to connect to the seat; and a first control device mounted and concealed between the first and second frames in order to prevent a user from inadvertently colliding with the first control device, wherein the first control device is adjusted for various relative pivotal positions of the first and second frames;

wherein the lateral wall of the seat frame defines a first lateral wall section and a second lateral wall section, with the first lateral wall section including a first recessed area formed thereof and the second lateral wall section including a second recessed area formed thereof, respectively, with the first recessed area including a first depth extending in a direction transverse to a direction that directs from a proximal end to a distal end of the first lateral wall section, with the second recessed area including a second depth extending in a direction transverse to a direction that directs from a proximal end to a distal end of the second lateral wall section.

2. The chair as claimed in claim 1 further comprising a second control device adjusted for various tilting positions of the backrest with respect to the seat.

3. The chair as claimed in claim 2, wherein the connecting member includes a first connection, a hooking member, a pivot, and a restoring member, wherein the first frame includes a fixing end including a base side, a lateral side, and a hooking member, with the pivot inserted through the first connection, the lateral side to fix the first frame to the seat pivotally, and wherein the restoring member has one hooking end anchored to the hooking member and another hooking end anchored to the hooking member, with the restoring member gradually tensioned as the first frame is gradually tilted away from the seat.

4. The chair as claimed in claim 3, wherein the second control device includes a control member, a locking member, and a restoring member, with the control member moveably connected to the seat and including an operation portion and a strut, with the operation portion received in the first recessed area and disposed outside the lateral wall of the seat frame of the seat and not extended outside an opening of the first recessed area when the backrest is fixed at a tilting position with respect to the seat, with the locking member moveably fixed to the connecting member by an engaging member, with the engaging member inserted through and moveably retained in a first slot defined in the connecting member and engaging with the locking member, with the locking member connected to the strut and including a detent selectively engaged with a position section defined in the lateral side in the fixing end of the first frame to fix the backrest at a tilting position with respect to the seat, with the restoring member connected to the strut.

5. The chair as claimed in claim 4, wherein the position section is defined from a plurality of bores each extending in the lateral side and radially disposed equally with respect to the pivot.

6. The chair as claimed in claim 5, wherein the detent is engaged in one of the plurality of bores defining the positioning section when the backrest is fixed at a tilting position with respect to the seat.

7. The chair as claimed in claim 1 further comprising another control device adjusted for various vertical positions of the seat with respect to the supporting structure.

8. The chair as claimed in claim 7, wherein the connecting member includes a first connection, a hooking member, a pivot, and a restoring member, wherein the first frame includes a fixing end including a base side, a lateral side, and a hooking member, with the pivot inserted through the first connection, the lateral side to fix the first frame to the seat pivotally, and wherein the restoring member has one hooking end anchored to the hooking member and another hooking end anchored to the hooking member, with the restoring member gradually tensioned as the first frame is gradually tilted away from the seat.

9. The chair as claimed in claim 8, wherein the other control device includes a control member, a locking member, and a restoring member, with the control member moveably connected to the seat and including an operation portion and a strut, with the operation portion received in the second recessed area and disposed outside the lateral wall of the seat frame of the seat and not extended outside an opening of the second recessed area when the seat is fixed at a vertical position with respect to the supporting structure, with the locking member moveably fixed to the connecting member by an engaging member, with the engaging member inserted through and moveably retained in a second slot defined in the connecting member and engaging with the locking member, with the locking member connected to the strut and selectively engaged with a position section defined in the supporting structure to fix the seat at a vertical position with respect to the supporting structure, with the restoring member connected to the strut.

10. The chair as claimed in claim 9, wherein the position section is defined from a plurality of recesses extending into an outer periphery of the supporting structure individually.

11. The chair as claimed in claim 10, wherein the locking member is engaged in one of the plurality of recesses defining the positioning section when the seat is fixed at a vertical position with respect to the supporting structure.

12. A chair comprising:

a supporting structure;

a seat moveably mounted on the supporting structure, wherein the seat is moveable with respect to the supporting structure in a vertical direction, wherein the seat includes a seat frame, a sitting element and a connecting member, with the seat frame including a base and a lateral wall extending upwardly from the base, with the sitting element including a top surface, a bottom surface opposite to the top surface and a peripheral edge extending laterally along circumferential edges of the top and bottom surfaces, with the connecting member mounted to the bottom surface of the sitting element, with the sitting element fixed to and disposed on the seat frame by mounting the bottom surface of the sitting element on the seat frame;

a backrest including a first frame pivotally connected to the seat and a second frame separate from and pivotally mounted on the first frame so as to connect to the seat;

a first control device mounted and concealed between the first and second frames in order to prevent a user from inadvertently colliding with the first control device, wherein the first control device is adjusted for various relative pivotal positions of the first and second frames; and a resilient member including a first end abutted against the connecting member and a second end abutted against the supporting structure, with the resilient member gradually compressed as well as the supporting structure gradually moved towards the connecting member as the seat is lowered from a position with respect to the supporting structure.

13. A chair comprising:

a supporting structure;

a seat moveably mounted on the supporting structure, wherein the seat is moveable with respect to the supporting structure in a vertical direction, wherein the seat includes a seat frame, a sitting element and a connecting member, with the seat frame including a base and a lateral wall extending upwardly from the base, with the sitting element including a top surface, a bottom surface opposite to the top surface and a peripheral edge extending laterally along circumferential edges of the top and bottom surfaces, with the connecting member mounted to the bottom surface of the sitting element, with the sitting element fixed to and disposed on the seat frame by mounting the bottom surface of the sitting element on the seat frame;

a backrest including a first frame pivotally connected to the seat and a second frame separate from and pivotally mounted on the first frame so as to connect to the seat; and a first control device mounted and concealed between the first and second frames in order to prevent a user from inadvertently colliding with the first control device, wherein the first control device is adjusted for various relative pivotal positions of the first and second frames;

wherein the connecting member includes a first connection, a hooking member, a pivot, and a restoring member, wherein the first frame includes a fixing end including a base side, a lateral side, and a hooking member, with the pivot inserted through the first connection, the lateral side to fix the first frame to the seat pivotally, and wherein the restoring member has one hooking end anchored to the hooking member of the connecting member and another hooking end anchored to the hooking member of the first frame, with the restoring member gradually tensioned as the first frame is gradually tilted away from the seat.

14. A chair comprising:

a supporting structure;

a seat moveably mounted on the supporting structure, wherein the seat is moveable with respect to the supporting structure in a vertical direction;

a backrest including a first frame pivotally connected to the seat and a second frame separate from and pivotally mounted on the first frame so as to connect to the seat; and a first control device mounted and concealed between the first and second frames in order to prevent a user from inadvertently colliding with the first control device, and wherein the first control device is adjusted for various relative pivotal positions of the first and second frames;

wherein the first control device includes a first control member, a support bracket, a locking member, a resilient member, retaining members, and an extending member, with the first control member hooked to the first frame, with the supporting bracket including a fixing base mounted on the first frame, a receiving section extending from the fixing base, with the locking member connected to the first control member and including a locking end, with the resilient member utilized between the first control member and the locking member, with the first control member moved upwardly to cause the locking member to go upwardly together depressing the restoring member, with the retaining members mounted to the second frame, with the extending member including a first distal end moveably engaged with supporting bracket and a second distal end engaged with the retaining member and including a positioning section selectively engaged with the locking end of the locking member, with the position section providing a plurality of positions that the locking end engages to enable the second frame to stop at a pivotal position relative to the first frame.

15. The chair as claimed in claim 14, wherein the seat includes a seat frame, a sitting element and a connecting member, with the seat frame including a base and a lateral wall extending upwardly from the base, with the sitting element including a top surface, a bottom surface opposite to the top surface and a peripheral edge extending laterally along circumferential edges of the top and bottom surfaces, with the connecting member mounted to the bottom surface of the sitting element, with the sitting element fixed to and disposed on the seat frame by mounting the bottom surface of the sitting element on the seat frame.

16. The chair as claimed in claim 14, wherein the second frame is disposed in front of the first frame, wherein when the user sitting on the chair abuts against the backrest, the user has his/her back in contact with and rested upon the second frame, with the first frame including a first connecting end and a second connecting end, with the second frame including a first connecting end and a second connecting end, with the first connecting end of the first frame pivotally connecting with the first connecting end of the second frame to enable a relative pivotal movement of the first and second frames, with the first control device connecting to the second connecting end of the first frame and the second connecting end of the second frame to mount between the first and second frames.

17. The chair as claimed in claim 14, wherein the receiving section of the supporting bracket includes a channel defined therein and a slit extending through a peripheral edge thereof and communicating with the channel, with the locking end of the locking member inserted into the slit of the receiving section.

18. The chair as claimed in claim 14, wherein the locking end of the locking member includes two protrusions and a space disposed between the two protrusions.

19. The chair as claimed in claim 14, wherein the positioning section of the extending member is defined from a plurality of protuberances, with two adjacent protuberances spaced by an interval.

* * * * *